US011332900B2

(12) United States Patent
Michel et al.

(10) Patent No.: US 11,332,900 B2
(45) Date of Patent: May 17, 2022

(54) SWEEPING BLADE AND SWEEPING BLADE ASSEMBLY FOR A VEHICLE

(71) Applicant: Usinage Pro24 Inc., Val-des-Sources (CA)

(72) Inventors: Hugo Michel, St-Rémi-de-Tingwick (CA); Zoltan Nemeth, Sherbrooke (CA)

(73) Assignee: GESTION PIHM INC., Val-des-Sources (CA)

( * ) Notice: Subject to any disclaimer, the term of this patent is extended or adjusted under 35 U.S.C. 154(b) by 0 days.

(21) Appl. No.: 17/353,184

(22) Filed: Jun. 21, 2021

(65) Prior Publication Data

US 2022/0018076 A1 Jan. 20, 2022

Related U.S. Application Data

(60) Provisional application No. 63/052,509, filed on Jul. 16, 2020.

(51) Int. Cl.
*E01H 5/06* (2006.01)

(52) U.S. Cl.
CPC ..... *E01H 5/066* (2013.01); *E01H 5/061* (2013.01)

(58) Field of Classification Search
CPC ..... E01H 5/065; E01H 5/066; E01H 5/061
See application file for complete search history.

(56) References Cited

U.S. PATENT DOCUMENTS 204,031 A 5/1878 Gruntler
520,479 A 5/1894 Bunnel
1,383,409 A 7/1921 Liddell
2,055,291 A 9/1936 Henry
2,116,351 A 5/1938 Jones et al.
(Continued)

FOREIGN PATENT DOCUMENTS

CA 1233983 3/1988
CA 2110949 6/1995
(Continued)

OTHER PUBLICATIONS

Canadian Intellectual Property Office, Written Opinion of the International Searching Authority and International Search Report for International Application No. PCT/CA2017/050082 dated Mar. 16, 2017, 12 pages.
(Continued)

*Primary Examiner* — Jamie L McGowan
(74) *Attorney, Agent, or Firm* — Bradley J. Thorson; DeWitt LLP

(57) ABSTRACT

A sweeping blade assembly includes a sweeping blade device and is configured to be attached to a plow blade of a vehicle for sweeping a ground surface. The assembly comprises a blade support which is securable to the plow blade and a plurality of sweeping blade devices which can be mounted to the blade support. Each sweeping blade device includes a blade main section and a wear block which can be attached to a front section of the blade main section in a lower portion thereof. The wear block(s) can optionally have at least one cut-out section(s) extending upwardly from a scraping edge of the wear block and can define at least two spaced-apart teeth in the lower portion of the wear block.

18 Claims, 9 Drawing Sheets

(56) References Cited

U.S. PATENT DOCUMENTS 2,762,139 A 9/1956 Launder
2,884,082 A 4/1959 Osterhaus
3,084,750 A 4/1963 Linden
3,160,967 A 12/1964 Nichols
3,400,475 A 9/1968 Peitl
3,454,108 A 7/1969 Skrukrud
3,455,041 A 7/1969 Roberts
3,465,456 A 9/1969 Meyer
3,514,830 A 6/1970 Takakita et al.
3,736,664 A 6/1973 Black et al.
3,772,803 A 11/1973 Cote
3,864,853 A 2/1975 Klett et al.
4,068,725 A 1/1978 Watson
4,159,584 A 7/1979 Niemela
4,166,640 A 9/1979 Van Denberg
4,249,323 A * 2/1981 Mathis ..... E01H 5/06 37/232
4,288,932 A 9/1981 Kuper
4,305,272 A 12/1981 Johnson
4,306,362 A * 12/1981 Waterman ..... E01H 4/02 37/219
4,307,523 A 12/1981 Reissinger et al.
4,570,366 A 2/1986 Yost
4,607,781 A * 8/1986 Shwayder ..... B23K 31/02 228/175
4,635,387 A 1/1987 Haring
4,669,205 A 6/1987 Smathers
4,671,363 A 6/1987 Bolinger
4,711,187 A 12/1987 Schultz
4,715,450 A * 12/1987 Hallissy ..... E02F 3/8152 172/701.3
4,770,253 A * 9/1988 Hallissy ..... E02F 9/285 172/701.3
4,794,710 A 1/1989 Haring
4,944,104 A 7/1990 Kowalczyk
5,025,577 A 6/1991 Verseef
5,032,342 A 7/1991 Drabing et al.
5,140,763 A 8/1992 Nichols, IV
5,191,729 A 3/1993 Verseef
5,211,247 A * 5/1993 Johnsen ..... A01B 31/00 172/197
5,309,653 A 5/1994 Pease et al.
5,437,113 A 8/1995 Jones
5,456,323 A 10/1995 Hill
5,471,770 A 12/1995 Ferreira
5,477,600 A 12/1995 Houle et al.
5,697,172 A 12/1997 Verseef
5,715,613 A * 2/1998 Ebert ..... E01H 5/066 37/221
5,743,032 A 4/1998 Vauhkonen
5,746,017 A 5/1998 Marvik
5,778,572 A 7/1998 Lukavich et al.
5,813,474 A 9/1998 Manway
5,819,443 A 10/1998 Winter
5,829,174 A 11/1998 Hadler et al.
5,881,480 A 3/1999 Fall
6,094,845 A 8/2000 Lela
6,145,858 A 11/2000 Foulquier
6,354,024 B1 3/2002 Kost et al.
6,854,527 B2 2/2005 Manway et al.
6,922,924 B2 8/2005 Jones et al.
7,028,584 B1 * 4/2006 Gracy ..... E04D 15/003 30/169
7,107,709 B2 9/2006 Hamel
7,467,485 B2 12/2008 Lachance et al.
7,631,441 B2 12/2009 Hunt
7,631,702 B2 12/2009 Hansen
7,665,234 B2 2/2010 Diehl et al.
7,874,085 B1 * 1/2011 Winter ..... E02F 3/8157 37/270
8,191,287 B2 6/2012 Winter et al.
8,984,778 B2 * 3/2015 Fox ..... E01H 5/062 37/266
9,121,151 B2 9/2015 Bergeron et al.
9,428,866 B2 8/2016 Sulesky
9,428,874 B2 * 8/2016 Winter ..... E02F 3/8152
9,562,342 B2 * 2/2017 Winter ..... E02F 9/26
D824,962 S * 8/2018 Winter ..... D15/11
10,138,607 B2 * 11/2018 Aquino ..... E01H 5/065
10,883,237 B2 1/2021 Michel et al.
10,889,948 B2 * 1/2021 Winter ..... E02F 9/26
2001/0005949 A1 7/2001 Amano et al.
2002/0078604 A1 6/2002 Kost et al.
2003/0066210 A1 4/2003 Hollinrake et al.
2003/0182824 A1 10/2003 Coffin et al.
2003/0188463 A1 10/2003 Manway et al.
2003/0221338 A1 12/2003 Verseef
2004/0177534 A1 9/2004 Jones et al.
2006/0070264 A1 4/2006 Lachance et al.
2007/0256334 A1 11/2007 Schmeichel
2007/0271828 A1 11/2007 Mishra et al.
2009/0223090 A1 9/2009 Hunt
2009/0307934 A1 12/2009 Wendorff et al.
2011/0225854 A1 * 9/2011 Winter ..... E01H 5/061 37/266
2011/0232927 A1 * 9/2011 Tutschek ..... E02F 3/8152 172/701.3
2012/0279092 A1 * 11/2012 Kueper ..... E01H 5/066 37/233
2013/0174452 A1 7/2013 Diehl et al.
2013/0185962 A1 7/2013 Reeves
2014/0259805 A1 * 9/2014 Fox ..... E01H 5/062 37/266
2014/0373398 A1 * 12/2014 Winter ..... E02F 3/8152 37/266
2015/0047234 A1 * 2/2015 Winter ..... B23K 35/025 37/460
2016/0069041 A1 * 3/2016 Winter ..... E01H 5/061 37/453
2016/0312421 A1 * 10/2016 Ummenhofer ..... E01H 4/02
2016/0319503 A1 * 11/2016 Westman ..... B60Q 1/28
2016/0354810 A1 * 12/2016 Zwerner ..... E01H 5/062
2017/0191236 A1 * 7/2017 Winter ..... E02F 3/8152
2018/0058026 A1 * 3/2018 Williams ..... E01H 5/066
2018/0100279 A1 * 4/2018 Aquino ..... E01H 5/061
2018/0171587 A1 * 6/2018 Parzynski, Jr. ..... E02F 9/2883
2019/0177954 A1 * 6/2019 Congdon ..... B23K 33/00
2019/0234034 A1 * 8/2019 Kovalick ..... E01H 5/061
2020/0385943 A1 * 12/2020 Proctor ..... E01H 5/066
2021/0254294 A1 * 8/2021 Harvey ..... E01H 5/065

FOREIGN PATENT DOCUMENTS

CA 2401809 3/2003
CA 2423830 7/2003
CA 2479905 3/2006
CA 2542919 10/2007
CA 2712715 2/2012
CA 2712716 2/2012
CA 2856940 6/2012
CH 306308 4/1955
DE 881200 6/1953
DE 7141159 7/1972
DE 2164525 6/1973
DE 2437723 12/1986
DE 4441654 6/1995
DE 10261421 7/2004
DE 102005040705 3/2007
EP 1234915 8/2002
EP 1247906 10/2002
EP 2495368 9/2012
FR 1243526 9/1960
FR 1255480 1/1961
FR 2539438 7/1984
FR 2656017 6/1991
GB 2502273 11/2013
JP H07034426 2/1995
SE 454279 B 4/1988
WO 199528526 10/1995
WO 2011123956 A1 10/2011

(56) References Cited

FOREIGN PATENT DOCUMENTS

| | | | |
|---|---|---|---|
| WO | 2012070943 | A1 | 5/2012 |
| WO | 2012/075564 | A1 | 6/2012 |
| WO | 2020/016220 | A1 | 1/2020 |

OTHER PUBLICATIONS

European Patent Office, Communication pursuant to Article 94(3) EPC for European Application No. 17 743 523.7-1004; dated Oct. 21, 2020, 5 pages.
European Patent Office, Supplementary European Search Report for European Application No. 17 743 52.7; dated Aug. 5, 2019, 3 pages.
European Patent Office, extended European search report for related Application No. 21180466.1 dated Dec. 10, 2021, 7 pages.

* cited by examiner

FIG. 12
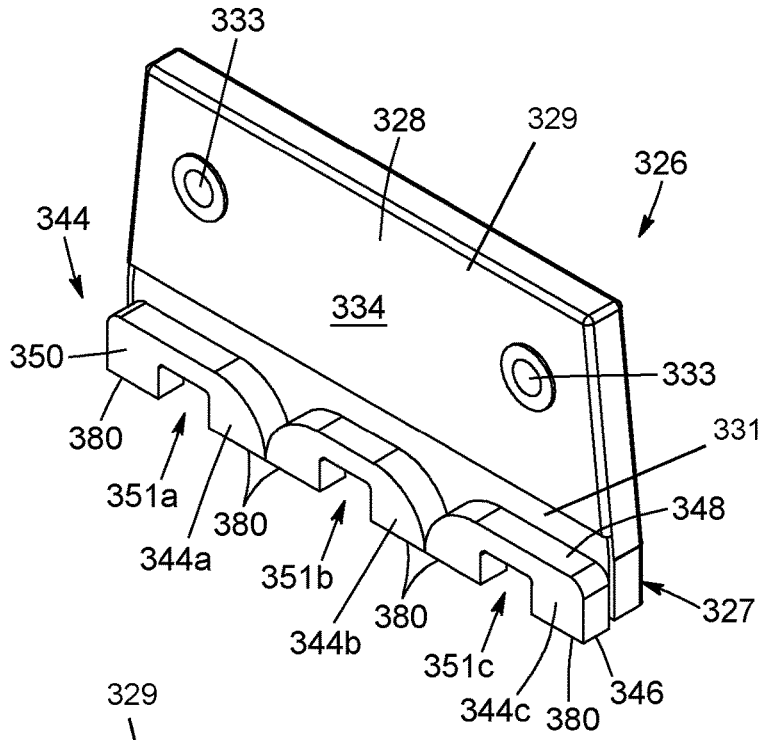
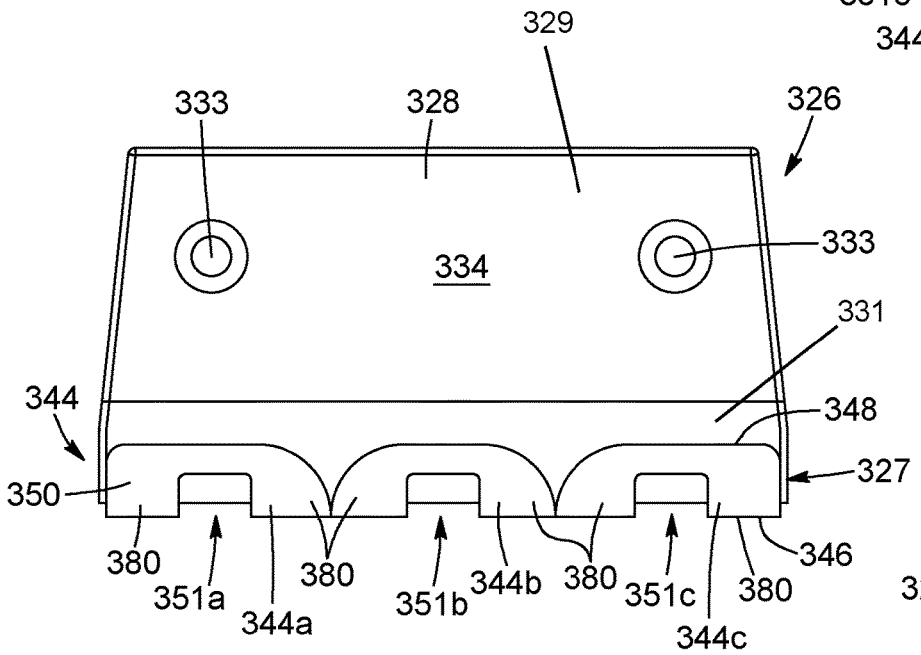
FIG. 13
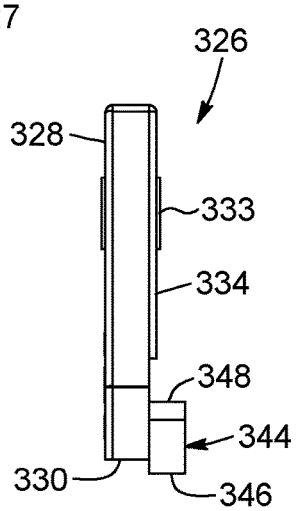
FIG. 14

FIG. 16
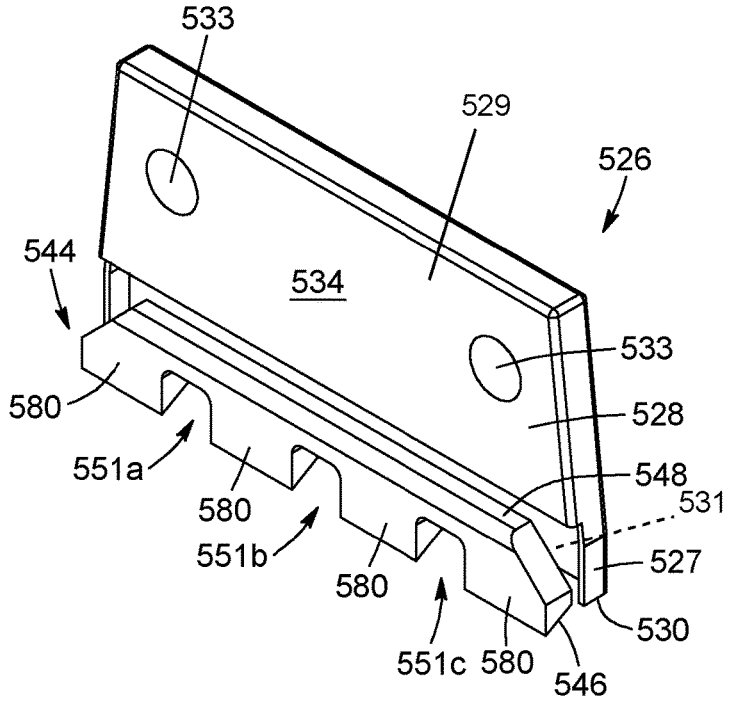
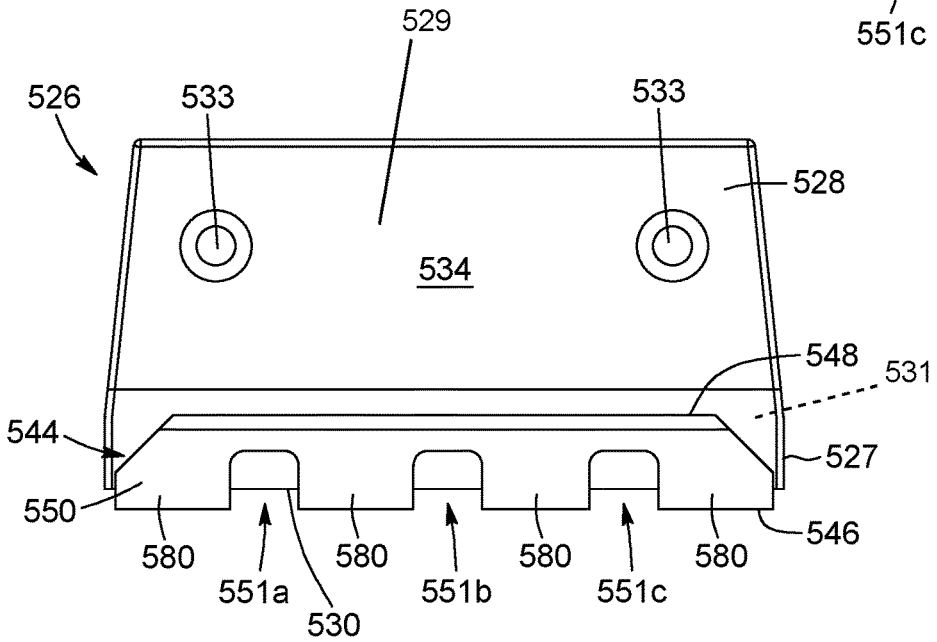
FIG. 17
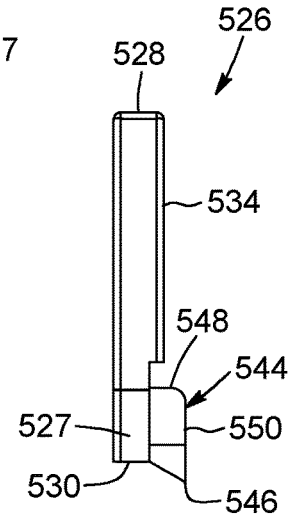
FIG. 18

SWEEPING BLADE AND SWEEPING BLADE ASSEMBLY FOR A VEHICLE

CROSS-REFERENCE TO RELATED APPLICATIONS

This application claims priority under 35 USC § 119(e) of U.S. provisional patent application 63/052,509 filed on Jul. 16, 2020, the specification of which is hereby incorporated by reference.

TECHNICAL FIELD

The present disclosure relates to snowplowing vehicles. More particularly, the present disclosure relates to sweeping blade devices and to sweeping blade assemblies for vehicles, such as snowplowing vehicles.

BACKGROUND

Snowplowing vehicles are well known in countries that experience significant snowfall and severe cold. Such vehicles include a sweeping blade which travels over the surface of a substrate such as a road, airport, runway, parking lot or the like for removing snow, ice, snowpacks, icepacks, debris such as gravel or rocks, or the like.

The typical challenge of these vehicles is the presence of uneven surfaces and obstacles on the road especially those of a protruding nature e.g. bumps, which cause uneven wear and premature damage to the blade and/or the entire assembly accompanied by an uneven cleaning of the areas surrounding the protruding obstacle. Another typical challenge of these vehicle results in the difficulty of easily installing, or alternatively easily replacing, the sweeping blade, as this component is very heavy. Such operation usually can not be performed by a single driver or operator of the snowplowing vehicle. These blades are often exposed to a lot of impacts with, for example, icepacks, manholes, bridge joints, rail tracks, rocks, other hard objects, etc. located in front of the snowplowing vehicle.

There already exists in the art sweeping blade assemblies that include a blade support, which can be secured to a vehicle (e.g., to a plow blade of a snowplowing vehicle), and a plurality of sweeping blade devices which can be secured to the blade support, making the blade replacement easier. Each one of the sweeping blade devices can be secured to the blade support using bolts and locknuts for example, allowing replacement of the individual sweeping blade devices, once damaged. Each sweeping blade device can be provided with a plurality of blade inserts or a hard facing along a scraping edge thereof. Indeed, each sweeping blade device can include a downwardly-opened longitudinal insert-receiving channel which can be configured for receiving the plurality of blade inserts. For example, the sweeping blade devices can be made from steel, while the blade inserts or hard facing can be made from carbide, ceramic, and the like.

These individual sweeping blade devices, while making the blade replacement easier, can be less resistant against impacts with icepacks, manholes, bridge joints, rail tracks, rocks, other hard objects, etc., during the scraping operations. Indeed, impacts between the icepacks and the sweeping blade devices can lead the carbide blade inserts to chip or to break, which can bring additional operating costs.

Therefore, there remains a need for improved sweeping blade assemblies and reinforced sweeping blade devices that allow for quick and convenient replacement of the sweeping blade devices on a blade support, while at least maintaining efficiency during snow removal operations or other similar operations and resistance of the whole assembly (i.e., sweeping blade device, blade inserts, etc.) against impacts, and which, by virtue of their designs and components, would be able to overcome or at least minimize some of the above-discussed concerns.

SUMMARY

It is an object of the present disclosure to provide sweeping blade devices and sweeping blade assemblies for vehicles adapted for sweeping a ground surface that overcome or mitigate one or more disadvantages of known sweeping blade devices and sweeping blade assemblies, or at least provide useful alternatives.

In accordance with an embodiment, there is provided a sweeping blade assembly configured to be attached to a plow blade of a vehicle for sweeping debris on a ground surface, the sweeping blade assembly comprising: a blade support securable to the plow blade of the vehicle; and a plurality of sweeping blade devices mounted to the blade support, each one of the sweeping blade devices comprising: a blade main section extending between a scraping edge and a blade upper edge, the blade main section defining a front surface; a bracket attached to the front surface of the blade main section in a lower portion thereof and defining a downwardly-opened longitudinal wear block-receiving channel; and a wear block secured to the bracket and having an upper portion inserted in the downwardly-opened longitudinal wear block-receiving channel and a lower portion extending downwardly from the downwardly-opened longitudinal wear block-receiving channel and exposed forwardly of the blade main section, the wear block extending between a scraping edge configured to contact both the debris and the ground surface and a block upper edge contained in the downwardly-opened longitudinal wear block-receiving channel, the wear block having at least one cut-out section extending upwardly from the scraping edge and defining at least two spaced-apart teeth in the lower portion of the wear block.

In one scenario, the blade main section can comprise a downwardly-opened longitudinal insert-receiving channel extending upwardly from the scraping edge thereof and a plurality of blade inserts at least partially inserted in the downwardly-opened longitudinal insert-receiving channel of the blade main section and secured to the blade main section.

In accordance with another embodiment, there is provided a sweeping blade device configured to be mounted to a blade support securable to a plow blade of a vehicle for sweeping debris on a ground surface, the sweeping blade device comprising: a blade main section extending between a scraping edge and a blade upper edge, the blade main section defining a front surface; and a bracket attached to the front surface of the blade main section at the scraping edge thereof and defining a downwardly-opened longitudinal wear block-receiving channel; a wear block having an upper portion inserted in the downwardly-opened longitudinal wear block-receiving channel and a lower portion extending downwardly therefrom, the wear block extending between a scraping edge configured to contact both the debris and the ground surface and a block upper edge, the wear block having at least one cut-out section extending upwardly from the scraping edge and defining at least two spaced-apart teeth in the lower portion of the wear block.

In accordance with a further embodiment, there is provided a sweeping blade device configured to be mounted to a blade support securable to a plow blade of a vehicle for sweeping debris on a ground surface, the sweeping blade device comprising: a blade main section extending between a scraping edge and a blade upper edge, the blade main section defining a front surface; and a wear block attached to the front surface of the blade main section at the scraping edge thereof, the wear block configured to contact the debris and extending between a scraping edge configured to contact the ground surface and a block upper edge.

In one scenario, the wear block can have at least one cut-out section extending upwardly from the scraping edge and defining at least two spaced-apart teeth in the lower portion of the wear block.

In accordance with a general aspect, there is provided a sweeping blade device configured to be mounted to a blade support securable to a vehicle. The sweeping blade device comprises: a blade main section extending between a blade scraping edge and a blade upper edge and having a front surface, the blade main section having a scraping marginal edge region extending upwardly from the blade scraping edge; and a wear block attached to the blade main section in the scraping marginal edge region, and protruding forwardly from the front surface of the blade main section, the wear block having a wear block scraping edge being aligned with or extending below the blade scraping edge to contact the ground surface.

In an embodiment, the wear block comprises at least one cut-out section extending upwardly from the wear block scraping edge and defining at least two spaced-apart teeth in a lower portion of the wear block. The wear block scraping edge can protrude downwardly from the blade scraping edge and the at least one cut-out section extending upwardly past the blade scraping edge can expose partially the scraping marginal edge region of the blade main section. The wear block can comprise a plurality of the at least one cut-out section.

In an embodiment, the sweeping blade device of claim 1, wherein the wear block scraping edge protrudes downwardly from the blade scraping edge. A length of a portion of the wear block extending downwardly past the blade scraping edge can range between about 0.1 inch and about 2 inches and, in a particular embodiment, between about 0.1 inch and about 1 inch.

In an embodiment, the sweeping blade device comprises a plurality of the wear block mounted in an adjacent configuration to the blade main section. The wear blocks can be juxtaposed along the blade scraping edge.

In an embodiment, the wear block scraping edge is beveled.

In an embodiment, the wear block is steel-based.

In an embodiment, the blade main section comprises a blade portion and a resilient material layer superposed to a front surface of the blade portion with the front surface of the blade portion being exposed forwardly in the scraping marginal edge region. The wear block can be superposed directly and secured to the front surface of the blade portion. The wear block can be welded to the front surface of the blade portion. The blade portion can be thinner in the scraping marginal edge region than in an upper portion thereof.

In an embodiment, the blade main section has a main blade height and the wear block has a wear block height, the wear block height ranging between about ⅙ and about ⅓ of the main blade height and, in a particular embodiment, between about ⅕ and about ¼ of the main blade height.

In an embodiment, the blade main section has a main blade thickness and the wear block has a wear block thickness, the wear block thickness ranging between about 0.5 time and about 2 times the main blade thickness and, in a particular embodiment, between about 0.75 time and 1.5 times the main blade thickness.

In accordance with another general aspect, there is provided a sweeping blade assembly configured to be attached to a plow blade of a vehicle for sweeping debris on a ground surface. The sweeping blade assembly can comprise: a blade support securable to the plow blade of the vehicle; and a plurality of the sweeping blade device as described above.

In accordance with still another general aspect, there is provided a sweeping blade device configured to be mounted to a blade support securable to a plow blade of a vehicle for sweeping debris on a ground surface. The sweeping blade device comprises: a blade main section extending between a scraping edge and a blade upper edge, the blade main section defining a front surface; and a bracket attached to the front surface of the blade main section at the scraping edge thereof and defining a downwardly-opened longitudinal wear block-receiving channel; and a wear block having an upper portion inserted in the downwardly-opened longitudinal wear block-receiving channel and a lower portion extending downwardly therefrom, the wear block extending between a scraping edge configured to contact both the debris and the ground surface and a block upper edge, the wear block having at least one cut-out section extending upwardly from the scraping edge and defining at least two spaced-apart teeth in the lower portion of the wear block.

In accordance with a further general aspect, there is provided a sweeping blade assembly configured to be attached to a plow blade of a vehicle for sweeping debris on a ground surface. The sweeping blade assembly comprises: a blade support securable to the plow blade of the vehicle; and a plurality of sweeping blade devices mounted to the blade support. Each one of the sweeping blade devices comprises: a blade main section extending between a scraping edge and a blade upper edge, the blade main section defining a front surface; a bracket attached to the front surface of the blade main section in a lower portion thereof and defining a downwardly-opened longitudinal wear block-receiving channel; and a wear block secured to the bracket and having an upper portion inserted in the downwardly-opened longitudinal wear block-receiving channel and a lower portion extending downwardly from the downwardly-opened longitudinal wear block-receiving channel and exposed forwardly of the blade main section, the wear block extending between a scraping edge configured to contact both the debris and the ground surface and a block upper edge contained in the downwardly-opened longitudinal wear block-receiving channel, the wear block having at least one cut-out section extending upwardly from the scraping edge and defining at least two spaced-apart teeth in the lower portion of the wear block.

In an embodiment, the blade main section comprises a downwardly-opened longitudinal insert-receiving channel extending upwardly from the scraping edge thereof and a plurality of blade inserts at least partially inserted in the downwardly-opened longitudinal insert-receiving channel of the blade main section and secured to the blade main section.

In this description, the terms "forward", "rearward", "front", "rear", "forwardly", and "rearwardly" as used herein are to be understood as relative terms descriptive of positions and/or directions taken with respect to the direction of forward travel of the vehicle onto which the sweeping blade assembly is mounted, unless otherwise specified.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which:

FIG. 12 is a top and front perspective view of a sweeping blade device in accordance with a further non-limitative embodiment, wherein the wear block comprises a plurality of adjacently mounted wear blocks;

FIG. 13 is a front elevation view of the sweeping blade device of FIG. 12;

FIG. 14 is a side elevation view of the sweeping blade device of FIG. 12;

FIG. 16 is a top and front perspective view of a sweeping blade device in accordance with a further non-limitative embodiment, wherein the wear block is directly mounted to a blade main section, comprises a plurality of cut-out sections, and has a different shape from the wear block shown in FIGS. 5 and 6;

FIG. 17 is a front elevation view of the sweeping blade device of FIG. 16; and FIG. 18 is a side elevation view of the sweeping blade device of FIG. 16.

DETAILED DESCRIPTION

Figure 1:
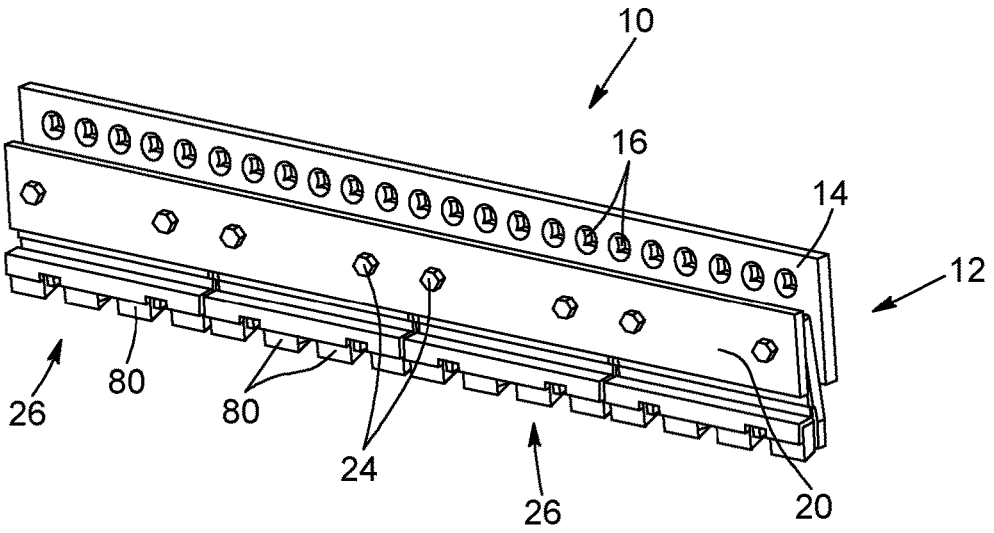
FIG. 1 is a top and front perspective view of a sweeping blade assembly in accordance with a non-limitative embodiment, the sweeping blade assembly being configured to be attached to a vehicle for sweeping a ground surface, wherein the sweeping blade assembly comprises a plurality of sweeping blade devices having a forwardly mounted bracket configured to receive a wear block.

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Furthermore, in the context of the present description, it will be considered that all elongated objects will have an implicit "longitudinal axis" or "centerline", such as the longitudinal axis of a shaft for example, or the centerline of a biasing device such as a coiled spring, for example, and that expressions such as "connected" and "connectable", "secured" and "securable", "engaged" and "engageable", "installed" and "installable" or "mounted" and "mountable", may be interchangeable, in that the present sweeping blade assembly or sweeping blade device also relates to kits with corresponding components for assembling a resulting fully-assembled and fully-operational sweeping blade assembly or sweeping blade device.

Moreover, components of the sweeping blade assembly, sweeping blade device, bracket and/or steps of the method(s) described herein could be modified, simplified, altered, omitted and/or interchanged, without departing from the scope of the present disclosure, depending on the particular applications which the present sweeping blade assembly or sweeping blade device is intended for, and the desired end results, as briefly exemplified herein and as also apparent to a person skilled in the art.

In addition, although the embodiments as illustrated in the accompanying drawings comprise various components, and although the embodiments of the present sweeping blade assembly or sweeping blade device and corresponding portion(s)/part(s)/component(s) as shown consist of certain geometrical configurations, as explained and illustrated herein, not all of these components and geometries are essential and thus should not be taken in their restrictive sense, i.e. should not be taken so as to limit the scope of the present disclosure. It is to be understood, as also apparent to a person skilled in the art, that other suitable components and cooperation thereinbetween, as well as other suitable geometrical configurations may be used for the present sweeping blade assembly, sweeping blade device, bracket and corresponding portion(s)/part(s)/component(s) according to the present sweeping blade assembly, as will be briefly explained herein and as can be easily inferred herefrom by a person skilled in the art, without departing from the scope of the present disclosure.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The present disclosure describes a sweeping blade assembly that is configured to be attached to a vehicle and, more particularly, to a plow blade of the vehicle, for sweeping a ground surface. In an embodiment, the sweeping blade assembly includes a plurality of sweeping blade devices that are configured to enhance removal of snow, ice and/or other debris that are provided on the ground surface. In an embodiment, the sweeping blade device is configured to maintain the resistance of the whole sweeping blade assembly by virtue of its design and components, overcomes or at least minimizes some of the above-discussed drawbacks.

Indeed, in accordance with a non-limitative embodiment, the sweeping blade assembly includes a blade support which is securable to a vehicle. For instance, it can be secured to a snowplow of the vehicle in a lower portion thereof. The sweeping blade assembly also includes a plurality of sweeping blade devices which are engageable, in turn, to the blade support. In one scenario, the plurality of sweeping blade devices can be detachably securable with the blade support. In one implementation, each sweeping blade device can include a blade main section which extends between a blade scraping edge and a blade upper edge. Each sweeping blade device also includes a wear block mounted to the blade main section and extending forwardly thereof. More particularly, the wear block is mounted to a marginal scraping edge region of the blade main section, adjacent to the blade scraping edge. It has a wear block scraping edge configured to contact the ground when mounted to the blade main section.

In an embodiment, each sweeping blade device can also include a bracket, which is attached to a front surface of the blade main section in a lower portion thereof. In an embodiment, the bracket defines a downwardly-opened longitudinal wear block-receiving channel. Thus, in an embodiment, one or more wear block(s) can have an upper portion inserted in the downwardly-opened longitudinal wear block-receiving channel and a lower portion exposed forwardly of the blade main section.

In an alternative embodiment, the wear block(s) can be directly mounted to the front surface of the blade main section in the lower portion thereof.

Each wear block extends between the wear block scraping edge and a wear block upper edge. The wear block scraping edge is configured to contact with the snow, ice or other debris located in front of the sweeping blade devices when the snowplow vehicle or apparatus is in operation, and the ground surface to be scraped.

In one scenario, the one or more wear block can have one or more cut-out section(s) formed therein and extending upwardly from the wear block scraping edge so as to allow at least some debris-contacting edges delimiting the cut-out section(s) to contact with the snow, ice or other debris and to potentially crush larger debris into smaller parts. The cut-out section(s) define spaced-apart teeth in the lower portion of the wear block(s).

In an alternative scenario, each reinforced sweeping blade device can include a plurality of wear block sections spaced-apart along a length of the downwardly-opened longitudinal wear block-receiving channel so as to allow debris-contacting edges of the wear blocks to contact with the snow, ice or other debris.

In another scenario, the one or more wear block can be free of cut-out section. They can be attached directly to the front surface of the blade main section or via the mounting bracket.

Optionally, each sweeping blade device can further include one or more wear block-supporting projection(s) having a portion extending forwardly and outwardly from the bracket in the operating direction of the snowplow vehicle or apparatus such that the wear block-supporting projection(s) can support the wear block(s).

Referring now to the drawings and more particularly to FIGS. 1 to 4, there is shown a sweeping blade assembly 10 in accordance with a non-limitative embodiment, which is configured to be attached to a vehicle (not shown) for sweeping a ground surface. The sweeping blade assembly 10 can be attached to a plow blade (not shown) of a snowplowing vehicle, in a lower portion thereof.

Still referring to the non-limitative embodiment of FIGS. 1 to 4, the sweeping blade assembly 10 includes a blade support 12 and a plurality of sweeping blade devices 26. The blade support 12 has an upper portion, which can be secured to the plow blade of the vehicle. The sweeping blade devices 26 are, in turn, mounted to the blade support 12. As mentioned above, it is noted that in one scenario, the sweeping blade devices 26 can be detachably securable to the blade support 12. The sweeping blade devices 26 are configured so as to travel over the ground surface, such as a road, a landing runway of an airport, a runway, a parking lot or the like, for removing snow, ice, debris or the like.

Figure 2:
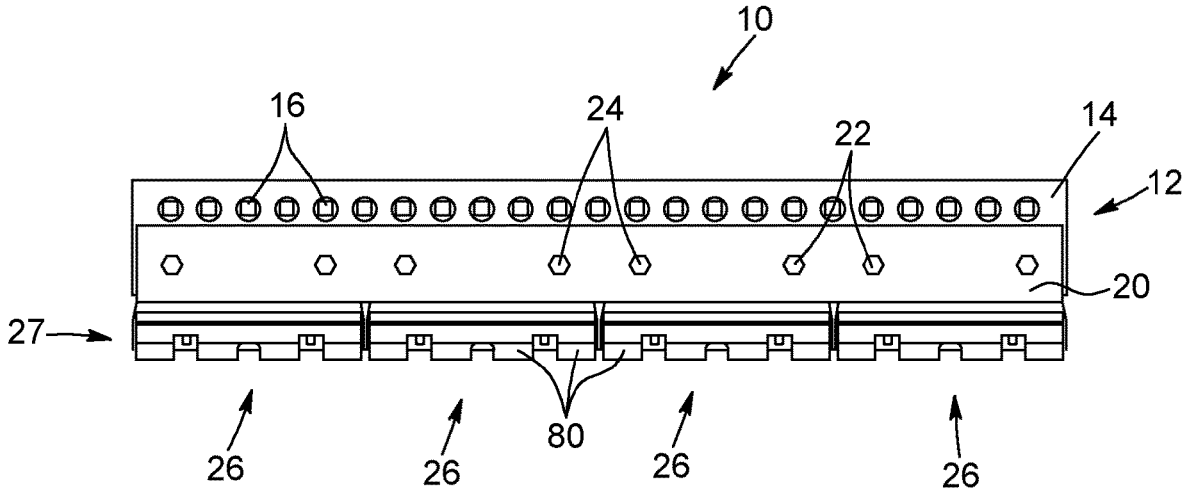
FIG. 2 is a front elevation view of the sweeping blade assembly of FIG. 1.

As shown in FIGS. 1 and 2, the blade support 12 is longer, along a longitudinal axis of the sweeping blade assembly 10, than each one of the sweeping blade devices 26. Therefore, the blade support 12 is configured to support a plurality of the sweeping blade devices 26 mounted in a longitudinally-adjacent configuration. This configuration of multiple longitudinally-adjacent sweeping blade devices 26 helps in efficiently clearing snow and ice debris, even in harsh conditions, as it will be described in more details below. In one implementation, the sweeping blade devices 26 can also be secured to a blade support in a way to work substantially independently (i.e., to move relative to the blade support 12 substantially independently from one another), for sweeping uneven ground surfaces more efficiently, for example (not shown). In the context of the present description, substantially independently with respect to the relative movement of the adjacent sweeping blade devices 26 is intended to mean that they can be independently mounted to the blade support 12.

Referring now more particularly to the non-limitative embodiment of FIGS. 1 and 2, the blade support 12 comprises a vehicle mounting (or first) portion or plate 14 and a sweeping blade mounting (or second) portion or plate 20, which is spaced-apart from the vehicle mounting portion 14. The blade support 12 includes a plurality of spaced-apart vehicle mounting apertures 16 which extend through the vehicle mounting portion 14, in an upper portion thereof, and which are spaced-apart from one another along a length (or longitudinal axis) of the blade support 12. The vehicle mounting apertures 16 allow universal attachment of the blade support 12 to the vehicle, such as to the plow blade of the vehicle, using a plurality of suitable mechanical fasteners (not shown) insertable therein, for example. Thanks to the plurality of spaced-apart vehicle mounting apertures 16, the blade support 12 is configured so as to fit substantially any vehicle or plow blade.

The blade support 12 further includes a first set of sweeping-blade mounting apertures (not shown) which extend through the vehicle mounting portion 14 and which are spaced-apart from one another along a length thereof. The first set of sweeping-blade mounting apertures are located below the plurality of spaced-apart vehicle mounting apertures 16 and are hidden by the sweeping blade devices 26 and the sweeping blade mounting portion 20 of the blade support 12 in FIGS. 1 and 2.

The blade support 12 further includes a second set of sweeping-blade mounting apertures 22 which extend through the sweeping blade mounting portion 20 of the blade support 12. As the first set of sweeping-blade mounting apertures, the second set of sweeping-blade mounting apertures 22 are spaced-apart along the length of the blade support 12. When assembled, the sweeping-blade mounting apertures of the first set are aligned with a corresponding one of the sweeping-blade mounting apertures 22 of the second set.

Figure 3:
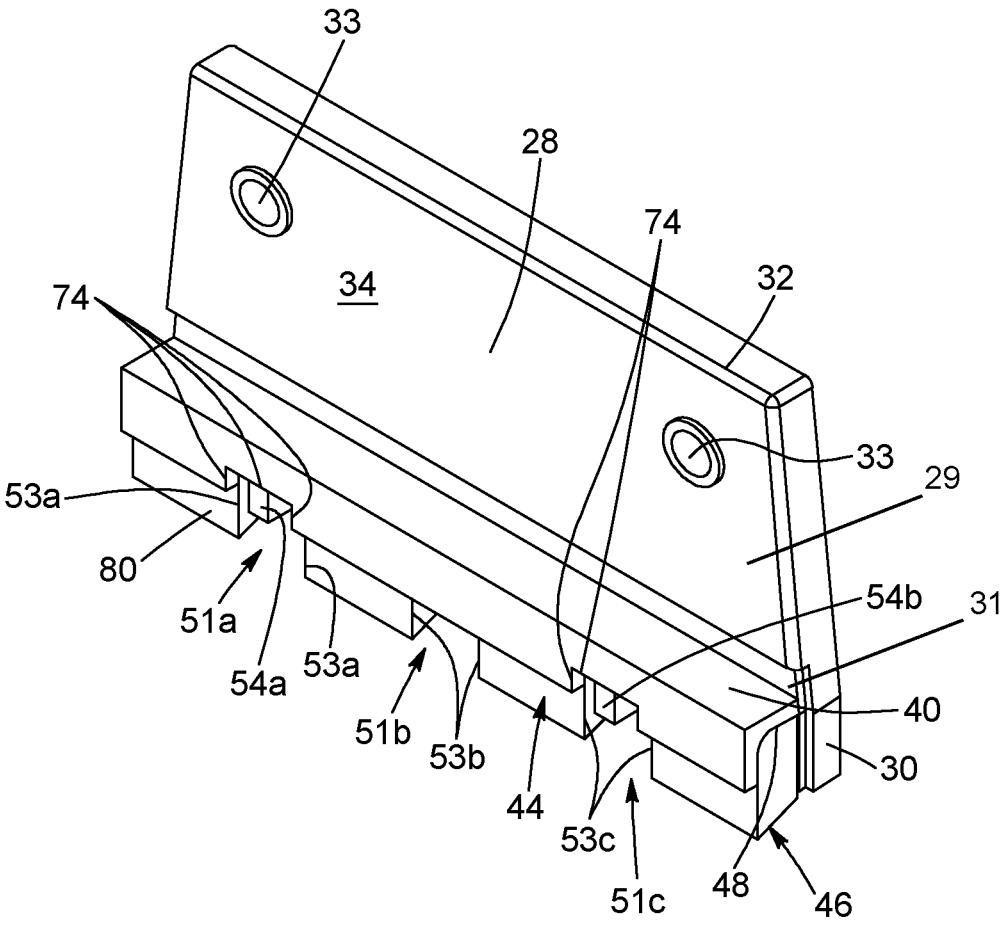
FIG. 3 is a top and front perspective view of one of the sweeping blade devices of the sweeping blade assembly shown in FIGS. 1 and 2.
Figure 4:
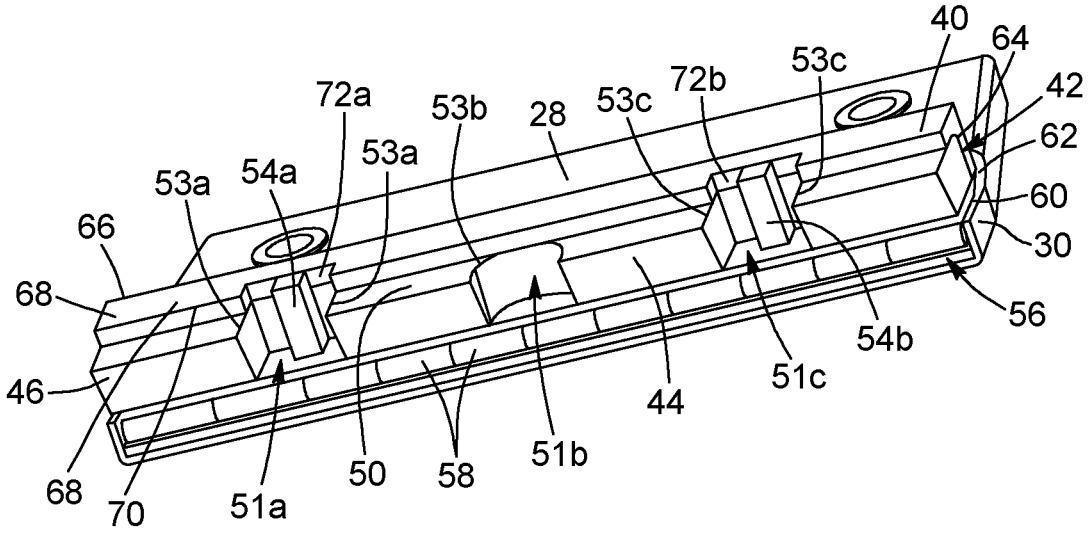
FIG. 4 is a bottom and front perspective view of the sweeping blade device of FIG. 3.

Now referring more particularly to the non-limitative embodiment of FIGS. 3 and 4, each sweeping blade device 26 comprises a blade main section 28. The blade main section 28 extends between a blade scraping edge or lower edge 30, which is adapted to contact with the ground surface, and a blade upper edge 32, which is found opposite to the scraping edge 30. The blade scraping edge 30 and the blade upper edge 32 extend substantially parallel to one another and along the the longitudinal axis of the blade main section 28. The blade main section 28 also defines a front or debris-contacting surface 34 and a rear surface or trailing surface, which is found opposite to the front surface 34. The blade main section 28 further includes blade-support mounting apertures 33 which extend therethrough. As will be described in more details below, the blade-support mounting apertures 33 allow attachment of the sweeping blade devices 26 to the blade support 12, using a plurality of suitable mechanical fasteners 24 (FIGS. 1 and 2) insertable therein, for example.

In the non-limitative embodiment, each sweeping blade device 26 comprises two longitudinally spaced-apart blade-support mounting apertures 33. However, it is appreciated that, in an alternative embodiment (not shown), each sweeping blade device 26 can comprise one or more than two longitudinally spaced-apart blade-support mounting aperture(s) 33.

Referring back to FIGS. 1 and 2, there is shown that the blade-support mounting apertures and the sweeping-blade mounting apertures have a circumference sufficient to allow a respective one of the mechanical fasteners 24 to pass therethrough. Furthermore, when assembled together, apertures from the first set of sweeping-blade mounting apertures, the blade-support mounting apertures 33, and the second set of sweeping-blade mounting apertures 22 are aligned or in registered in a manner such that the mechanical fasteners can be inserted therein. Each mechanical fastener 24 is of a sufficient length such that a distal end thereof can pass through a mounting aperture that extends through the vehicle mounting portion 14 of the blade support 12, through a corresponding blade-support mounting aperture 33 which extends through the blade main section 28 of a sweeping blade device 26, and through a corresponding sweeping-blade mounting aperture 22 which extends through the sweeping blade mounting portion 20 of the blade support 12, such that a nut, for example, can be threaded onto the distal end of the mechanical fastener 24. When the distal ends of the mechanical fasteners 24 are passed through the mounting apertures of the vehicle mounting portion 14, through the blade apertures 33, and through the mounting apertures 22, and nuts are fastened thereto, the sweeping blade devices 26 can be held securely between the vehicle mounting portion 14 and the sweeping blade mounting portion 20 of the blade support 12 with the lower or scraping edge 30 of each sweeping blade device 26 extending downwardly from the blade support 12, i.e. from the vehicle mounting portion 14 and the sweeping blade mounting portion 20, and can be positioned for scraping the surface, a road covered with snow, ice or other debris, for example. A person skilled in the art to which the present sweeping blade assembly 10 pertains would however understand that other attachment means could be used to secure the sweeping blade devices 26 to a blade support.

It can also be appreciated by a person skilled in the art to which the sweeping blade assembly 10 pertains that vehicles other than snowplowing vehicles can be equipped with the above-described blade support 12. It is also noted that the blade support 12 can be comprised of one elongated blade support 12, as shown in FIGS. 1 and 2, or can be comprised of multiple blade supports mounted to the vehicle in an adjacent configuration (not shown).

The blade support 12 can be secured to a front, rear or side of a snowplowing vehicle or snowplowing apparatus. The blade support 12 can be secured to the front, rear or side of the vehicle using the plurality of suitable mechanical fasteners insertable in at least some of the spaced-apart vehicle mounting apertures 16, for example, which are then inserted into corresponding apertures (e.g., threaded apertures) provided on the front, rear or side of the vehicle or apparatus (not shown).

The mechanical fasteners can be shaped such that a head of the mechanical fastener can sit beneath a surface defined by the vehicle mounting portion 14 once it has been inserted through a respective vehicle mounting aperture 16. While the blade support 12 can be releasably secured to the vehicle using suitable mechanical fasteners, such as bolts and lock-nuts, it can be appreciated by the person skilled in the art that various other attachment methods can be used, including studs, press fit studs, rivets or adhesive, for example. The blade support 12 can even be permanently attached to the vehicle or apparatus by, for example, welding, tack welding or other methods. It is noted that the blade support 12 can be of varying lengths and heights. For example, the blade support 12 can be between about 36 and 60 inches in length.

The blade support 12 and the blade main section 28 of the sweeping blade devices 26 can be made of a hard, durable material. For example, the blade support 12 and the blade main sections 28 can be steel-based. In an embodiment, the blade main sections 28 can be provided with a plurality of blade inserts 58 (FIG. 4) or a hard facing (not shown) along the blade scraping edges 30 thereof. Indeed, in one scenario, each blade main section 28 can include a downwardly-opened longitudinal insert-receiving channel 56 which can be configured for receiving the plurality of blade inserts 58. Thus, each sweeping blade device 26 and blade main section 28 can therefore be made from a plurality of materials depending on the application of the sweeping blade assembly 10. As mentioned above, the blade main sections 28 can be steel-based but also include blade inserts 58 or hard facing made of hard/wear/abrasion resistant materials known to the person skilled in the art, for example, carbide (such as tungsten titanium carbide (WTiC)), ceramic, etc.

The sweeping blade devices 26 can be of varying lengths and heights. For example, the sweeping blade devices 26 can be between about 4 and 12 inches in height. On the other hand, the sweeping blade devices 26 can be between about 6 inches and 24 inches in length. An advantage of using sweeping blade devices 26 of relatively short lengths and of a configuration as the one illustrated in FIG. 3, defining a trapeze-shaped configuration with the scraping edge 30 being wider than the blade upper edge 32, is that the sweeping blade devices 26 will be lighter to transport as part of a replacement kit, for example, or on their own, and they will be easier to remove and replace, which can be especially beneficial for drivers or operators in the field. It is noted that each sweeping blade device can however take any shape, size or configuration, as long as it is configured so as to contact with both the ground surface to be scraped and the debris in front of sweeping blade assembly 10. For instance, in the non-limitative embodiment shown, the blade main sections 28 of the sweeping blade devices 26 have tapered lateral edges extending between the blade scraping edge 30 and the blade upper edge 32. However, it is appreciated that the shape of the lateral edges can vary from the embodiment shown. For instance, they can be substantially straight lateral edges, thereby providing a substantially rectangular profile to the blade main section 28.

As best shown in FIGS. 1 and 2, once the sweeping blade devices 26 are mounted to and between the vehicle mounting portion 14 and the sweeping blade mounting portion 20 of the blade support 12, lower portions 27 of the sweeping blade devices 26 extend outwardly (i.e., downwardly) past the blade support 12. The lower portions 27 of the sweeping blade devices 26 are therefore exposed.

Still referring to the non-limitative embodiment of FIGS. 1 to 4, each sweeping blade device 26 further includes a wear edge mounting bracket 40 which defines a downwardly-opened longitudinal wear block-receiving channel 42. One or more wear (or durable) block 44 can be at least partially inserted in the wear block-receiving channel 42. Each one of the wear (or durable) block 44 extends between a wear block upper edge 48 and a wear block scraping edge 46. When mounted to the sweeping blade device 26, the wear block 44 has an upper portion, including the upper edge 48, contained inside the wear block-receiving channel 42, as will be described in details below.

The bracket 40 is attached to the front surface 34 of the blade main section 28 in a scraping marginal edge region, i.e. in a region extending upwardly from the blade scraping edge 30, or in the lower portion 27 thereof. The bracket 40 and the wear block(s) 44 protrude forwardly from the front surface 34 of the blade main section 28. More particularly, a lower portion of the wear block including the wear block scraping edge 46 is exposed forwardly, i.e. uncovered by the bracket 40, to be in contact with the debris, when the snowplow vehicle or apparatus is in operation, and the wear block scraping edge 46 also being in contact with the surface to be scraped. In the embodiment shown, the wear block scraping edge 46 is substantially aligned with the blade scraping edge(s) 30. Thus, both the scraping edges 30 of the blade main sections 28 and the scraping edges 46 of the wear blocks 44 are in contact with the surface to be scraped, while a front face 50 of the wear blocks 44, in the lower portion thereof, can also contact with the snow, ice or other debris located in front of the sweeping blade devices 26. In an alternative embodiment, when unworn, the wear block scraping edge 46 can extend below the blade scraping edge(s) 30. Thus, for a new or substantially new wear block, only the wear block scraping edge 46 can contact the ground surface.

Still referring to the non-limitative embodiment of FIGS. 1 to 4, each sweeping blade device 26 includes one wear block 44 which comprises a plurality of cut-out sections 51*a*, 51*b*, 51*c* extending through the wear block 44 from the scraping edge 46. The cut-out sections 51*a*, 51*b*, 51*c* define a plurality of teeth 80 with adjacent ones of the teeth 80 being spaced-apart by one of the cut-out sections 51*a*, 51*b*, 51*c* in the lower portion of the wear block 44. At a junction of the cut-out sections 51*a*, 51*b*, 51*c* with a front face 50 of the wear block 44, the teeth 80 are delimitated by debris-contacting edges 53*a*, 53*b*, 53*c* extending upwardly from the scraping edge 46. Thus, as shown, the cut-out sections 51*a*, 51*b*, 51*c* are spaced-apart along a length of the wear block 44 and allow debris-contacting edges 53*a*, 53*b*, 53*c*, delimiting the cut-out sections 51*a*, 51*b*, 51*c*, to contact with the snow, ice or other debris and to potentially crush them into smaller parts prior to be scraped.

As best shown in the non-limitative embodiment of FIG. 4, the wear block mounting bracket 40 can optionally include a blade mounting wall 60 which can be superposed to the front surface 34 of the blade main section 28, an upper wall 64 which extends substantially perpendicularly from the blade mounting wall 60 at an uppermost edge 62 thereof (or alternatively, which can extend substantially perpendicularly from the blade main section 28), and a debris-contacting wall 68 which extends substantially perpendicularly and downwardly from the upper wall 64 at a frontmost edge 66 thereof and covers the upper portion of the front face 50 of the wear block 44. The blade mounting wall 60, the upper wall 64 and the debris-contacting wall 68 can therefore together define the downwardly-opened longitudinal wear block-receiving channel 42 which is configured to receive the wear block 44 therein. As shown, the blade-mounting wall 60, the upper wall 64 and the debris-contacting wall 68 can be integrally formed and the bracket 40 can be welded to the front surface 34 of the blade main section 28. It is also noted that the wear block 44 can be welded to at least one of the internal surfaces of the bracket walls 60, 64, 68 defining the downwardly-opened longitudinal wear block-receiving channel 42. A person skilled in the art to which the present sweeping blade device 26 pertains would however understand that other attachment means could be used to secure the bracket 40 to the blade main section 28, or the wear block 44 to the wear block mounting bracket 40, including studs, press fit studs, rivets or adhesive, for example. In an embodiment, the wear block mounting bracket 40 can be permanently attached to the vehicle or apparatus by, for example, welding, tack welding or other methods.

Therefore, a rear surface of the wear block 44 can be superposed to the blade mounting wall 60, the upper edge 48 of the wear block 44 can be superposed to the upper wall 64, and an upper section of the block front surface 50 can be superposed to the debris-contacting wall 68.

In an alternative embodiment (not shown), the wear block mounting bracket 40 can be free of blade mounting wall 60 and the front surface 34 of the blade main section 28 can be exposed in the downwardly-opened longitudinal wear block-receiving channel 42.

The wear block mounting bracket 40 can further include bracket cut-out sections 72*a*, 72*b* which extend through the debris-contacting wall 68, at a lowermost edge 70 thereof and in alignment with the cut-out sections 51*a*, 51*c*. As shown, the bracket cut-out sections 72*a*, 72*b* are spaced-apart along a length of the bracket 40 and allow bracket debris-contacting edges 74 delimiting the bracket cut-out sections 72*a*, 72*b* to contact with the snow, ice or other debris.

Indeed, referring now to FIGS. 3 and 4, there is shown that each sweeping blade device 26 can further include wear-block-supporting projections 54*a*, 54*b* which extend outwardly and downwardly from the bracket 40 in the operating direction of the snowplow vehicle or apparatus so as to support the wear block 44. More particularly, bracket mounting or distal ends of the wear block-supporting projections 54*a*, 54*b* can be secured to the blade mounting wall 60 of the bracket 40, and substantially centrally disposed in at least one or more of the cut-out sections 51*a*, 51*c*. For example, the bracket mounting ends of the wear block-supporting projections 54*a*, 54*b* can be welded to the bracket 40 after an upper portion of the wear block 44 has been introduced into the downwardly-opened longitudinal wear block-receiving channel 42. A person skilled in the art to which the present sweeping blade device 26 pertains would however understand that other attachment means could be used to secure the wear block-supporting projections 54*a*, 54*b* to the bracket 40, as mentioned above.

It will be appreciated by a person skilled in the art to which the sweeping blade assembly 10 or sweeping blade device 26 pertains that the wear block 44 can take any shape, size or configuration, with the scraping edge 46 of the wear block 44 being exposed to the debris. Optionally, the wear block 44 can include at least one cut-out section that extends therethrough and upwardly from the scraping edge 46, thus presenting at least one debris-contacting edge that extends downwardly from the downwardly-opened longitudinal wear block-receiving channel 42, for example. It is thus noted that one or more cut-out section(s) can extend through the wear block 44 and can be positioned anywhere along the length of the wear block 44. The cut-out section(s) can take any shape, size or configuration and can, for example, have a squared shape (e.g., cut-out sections 51*a*, 51*c*), a semi-circular shape (e.g., cut-out section 51*b*), a regular shape, and irregular shape, etc. The exposed debris-contacting edges can thus be straight, curved, etc. It will also be appreciated by a person skilled in the art to which the sweeping blade assembly 10 or sweeping blade device 26 pertains that the wear block mounting bracket 40 can take any shape, size or configuration. However, once the wear block 44 is securely held in place within the downwardly-opened longitudinal wear block-receiving channel 42 with the wear-block supporting projections 54*a*, 54*b* supporting the wear block 44, if any, the lower portion of the wear block 44 including the scraping edge 46 extends outwardly (i.e., downwardly) past the downwardly-opened longitudinal wear block-receiving channel 42, and more particularly, past a lowermost edge 70 of the debris-contacting wall 68 of the bracket so that the lower portion of the wear block 44 can be in contact with the ground surface to be scraped but also, exposed to the debris.

Similarly, it will be appreciated by a person skilled in the art to which the sweeping blade assembly 10 or sweeping blade device 26 pertains that the wear block-supporting projections 54*a*, 54*b*, if any, can take any shape, size or configuration to support the wear block 44. A person skilled in the art to which the sweeping blade device 26 pertains would understand that one or more wear block-supporting projection(s) can extend from the blade mounting wall 60 of the bracket 40 and be disposed in any cut-out section 51*a*, 51*b* or 51*c*. The wear block-supporting projections 54*a*, 54*b* can, for example, define a squared cross-section, a circular cross-section, a semi-circular cross-section, a regular cross-section, an irregular shape cross-section, etc., with upper portions thereof being interfacing with the wear block. As best shown in FIG. 4, the wear block-supporting projections 54*a*, 54*b* can have a substantially elongated shape.

It is noted that the wear block mounting bracket 40 and the corresponding wear block 44 can be of varying lengths and heights. For example, the bracket 40 and the wear block 44 can have a length that corresponds to the length of the blade main section 28. For example, the length of the bracket 40 or wear block 44 can be between about 6 and 24 inches in length. Thus, the wear block mounting bracket 40 can be comprised of one elongated bracket, as shown in FIGS. 1 and 2, or can be comprised of multiple brackets mounted to the vehicle in an adjacent configuration (not shown). In an alternative embodiment, the bracket 40 can have a length that corresponds to the length of the blade main section 28 while the wear blocks 44 can be shorter in length in a manner such that one bracket 40 can be designed to receive and support a plurality of wear block sections in its downwardly-opened longitudinal wear block-receiving channel 42.

The bracket 40 and the wear block 44 can be made from a variety of materials depending on the application of the sweeping blade assembly 10. For example, the bracket 40 and the wear block 44 can be made of steel, cast iron of any durable materials known to the person skilled in the art.

By fixing the bracket 40 to the front surface 34 of the blade main section 28 and by allowing the scraping edge 46 of the wear block 44 to be in contact with the debris, the resistance of the sweeping blade devices 26 against potential impacts (i.e., icepacks, manholes, bridge joints, rail tracks, rocks, other hard objects, etc.) can be increased. Therefore, it can be considered that the sweeping blade devices 26 are reinforced in comparison with similar sweeping blade devices manufactured without the wear block(s) 44. Also, the serrated design of the sweeping blade devices 26, provided by the alternating teeth 80 and cut-out sections 51*a*, 51*b*, 51*c* can help to crush or grind the debris located in front of the reinforced sweeping blade devices 26 during operation of the apparatus. The improved sweeping blade devices 26 can therefore increase the overall strength of the sweeping blade assembly 10 and can help in efficiently clearing snow and ice from roads, even in harsh conditions.

In an alternative implementation of the sweeping blade assembly 10, it is noted that each sweeping blade device 26 can include a plurality of wear block sections spaced-apart along a length of the downwardly-opened longitudinal wear block-receiving channel 42 so as to allow the section of the debris-contacting edges of the wear blocks that extend downwardly from the downwardly-opened longitudinal wear block-receiving channel 42 to contact with the snow, ice or other debris and the surface to be scraped (instead of including one wear block 44 having a lower portion which downwardly extends from the downwardly-opened longitudinal wear block-receiving channel 42). Each wear block (or wear block section) can include a plurality of cut-out sections extending upwardly through from the scraping edge 46 and spaced-apart along a length thereof to define wear teeth inbetween, or alternatively, only one cut-out section. The wear block(s) can also be provided without any cut-out section. A person skilled in the art to which the reinforced sweeping blade devices pertain would also understand that wear block(s) can also be attached directly to the front surface 34 of the blade main section 28, as it will be described in more details below. Furthermore, in an alternative embodiment, the the downwardly-opened longitudinal wear block-receiving channel 42 configured in an adjacent and juxtaposed configuration in the downwardly-opened longitudinal wear block-receiving channel 42.

Figure 5:
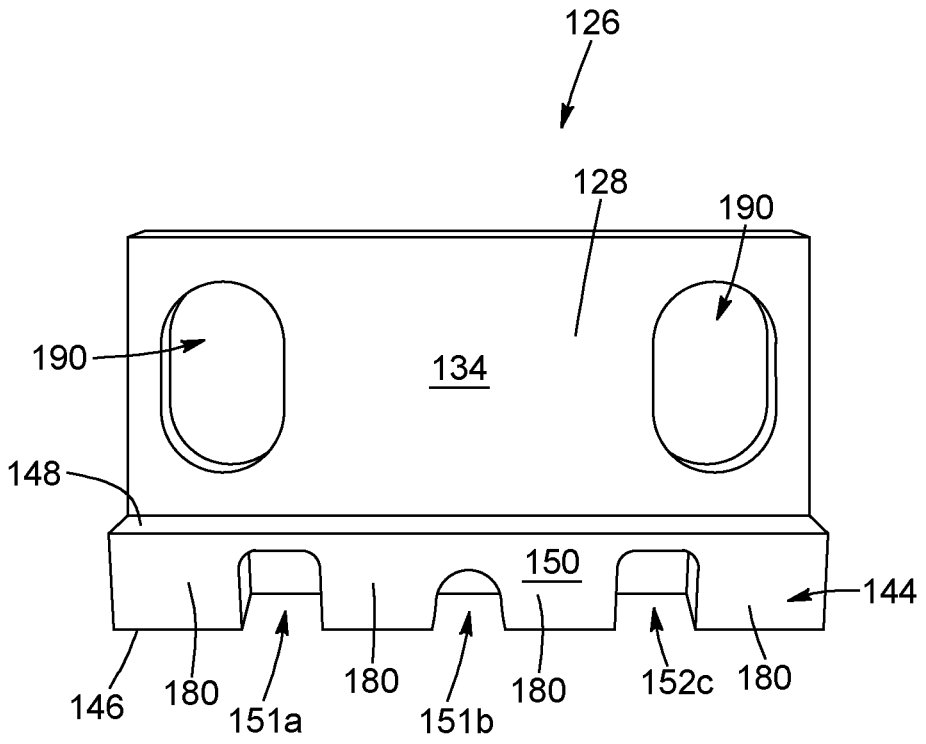
FIG. 5 is a front elevation view of a sweeping blade device in accordance with another non-limitative embodiment, wherein a wear block including cut-out sections is directly mounted to a blade main section of the sweeping blade device.
Figure 6:
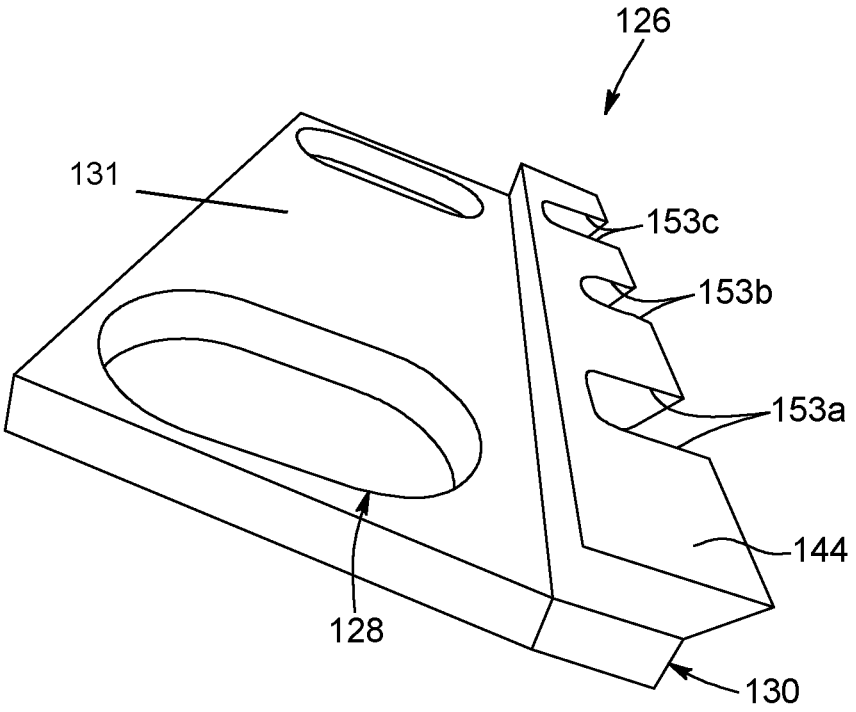
FIG. 6 is a top and side perspective view of the sweeping blade device of FIG. 5.
Figure 7:
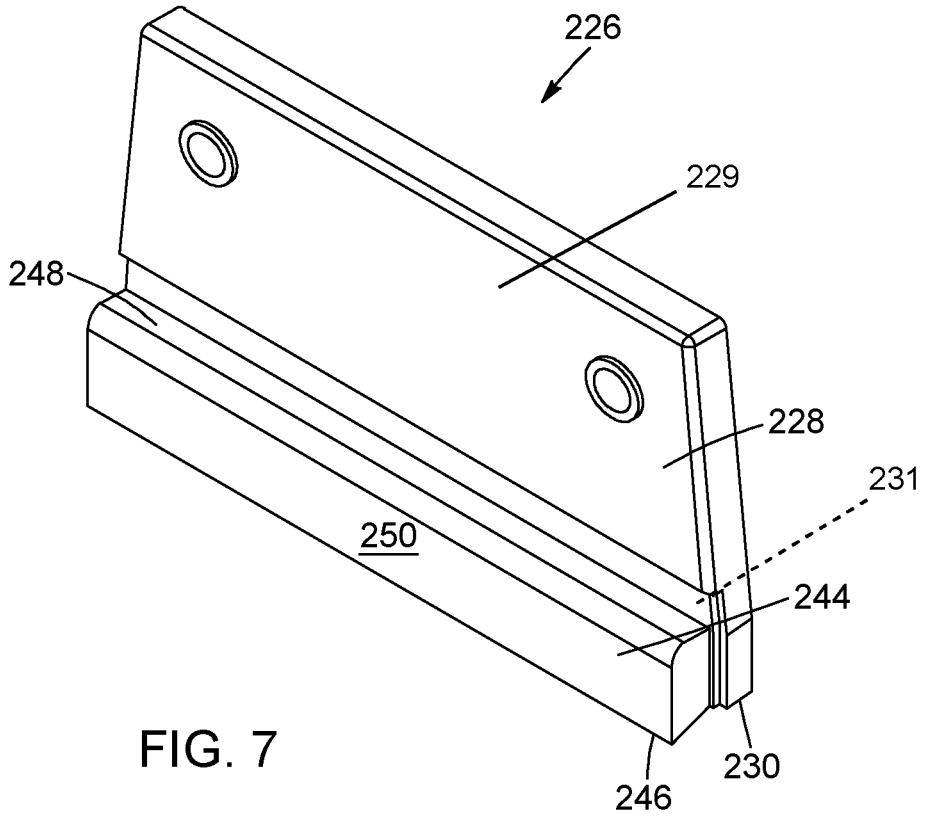
FIG. 7 is a top and front perspective view of a sweeping blade device in accordance with a further non-limitative embodiment, wherein the wear block is directly mounted to the blade main section of the sweeping blade device and is free of cut-out section.

Referring to FIGS. 5 and 6, there is shown an alternative embodiment of the sweeping blade device wherein the features are numbered with reference numerals in the 100 series which correspond to the reference numerals of the previous embodiment.

Indeed, as best shown in the non-limitative embodiment of FIGS. 5 and 6, the sweeping blade device 126 has a blade main section 128 and a wear block 144 attached to the blade main section 128 in the scraping marginal edge region 127 (or lower portion). The wear block 144 protrudes forwardly from the front surface 134 of the blade main section 128.

The wear block 144 has a blade mounting surface or rear surface that is superposed directly to the front surface 134 of the blade main section 128. A block front surface 150 can thus be exposed in its entirety to ice and snow debris. The wear (or durable) block 144 extends between an upper edge 148 and a scraping edge 146. The wear block 144 is secured to the front surface 134 of the blade main section 128 at the lower portion 127 thereof such that the entire wear block 144 can be in contact with the debris when the snowplow vehicle or apparatus is in operation. In other words, the sweeping blade device 126 is free of wear block mounting bracket and the wear block 144 is directly mounted to the blade main section 128.

As best shown in the non-limitative embodiment of FIG. 6, the scraping edge 146 of the wear block 144 can be beveled, with the height of the wear block 144 increasing along the operating direction of the snowplow vehicle or apparatus (i.e. a forwardly increasing height), so that once the sweeping blade assembly (not shown) or sweeping blade devices 126 are provided in a tilted operating configuration (as shown in FIG. 6), the scraping edges 146 of the wear blocks 144 can scrape the surface, i.e. they extend substantially parallel thereto. It is appreciated that the attack angle of the scraping edges 146 can vary. Thus, in the embodiment shown, the wear block scraping edge 146 extends at least partially below the blade scraping edge 130 to contact the ground surface.

Still referring to the non-limitative embodiment of FIGS. 5 and 6, the wear block 144 comprises a plurality of cut-out sections 151*a*, 151*b*, 151*c* which extend through the wear block 144 upwardly from the scraping edge 146. The cut-out sections 151*a*, 151*b*, 151*c* define a plurality of teeth 180 with adjacent ones of the teeth 180 being spaced-apart by one of the cut-out sections 151*a*, 151*b*, 151*c* in the lower portion of the wear block 144. At the front face 150 of the wear block 144, the teeth 180 are delimitated from the cut-out sections 151*a*, 151*b*, 151*c* by debris-contacting edges 153*a*, 153*b*, 153*c* extending upwardly from the scraping edge 146. Thus, as shown, the cut-out sections 151*a*, 151*b*, 151*c* are spaced-apart along a length of the wear block 144 and allow debris-contacting edges 153*a*, 153*b*, 153*c* delimiting the cut-out sections 151*a*, 151*b*, 151*c* to contact with the snow, ice or other debris and to potentially crush them into smaller parts prior to be scraped.

As shown, the wear block 144 can be welded to the front surface 134 of the blade main section 128. A person skilled in the art to which the present sweeping blade device 126 pertains would however understand that other attachment means could be used to secure the wear block 144 to the blade main section 128, including mechanic fasteners, studs, press fit studs, rivets or adhesive, for example. One or more wear block-supporting projection(s) (not shown) can also extend outwardly from the blade main section 128 in the operating direction of the snowplow vehicle or apparatus to help supporting the wear block 144. More particularly, blade mounting or distal ends of such wear block-supporting projection(s) can be secured to the blade main section 128, and substantially centrally disposed in at least one or more of the cut-out sections 151*a*, 151*b* and/or 151*c*. For example, the blade mounting end(s) of the wear block-supporting projection(s) can be welded to the blade main section 128. A person skilled in the art to which the present sweeping blade device 126 pertains would however understand that other attachment means could be used to secure the one or more wear block-supporting projection(s) to the blade main section 128.

It will be appreciated by a person skilled in the art to which the sweeping blade device 126 pertains that the wear block 144 can take any shape, size or configuration, with the entire wear block 144 being exposed to the debris and including at least one cut-out section 151*a*, 151*b*, 151*c* that extends therethrough, thus presenting at least one debris-contacting edge 153*a*, 153*b*, 153*c* that extends upwardly from the scraping edge 146, for example. It is thus noted that one or more cut-out section(s) can extend through the scraping edge 146 of the wear block 144 and can be positioned anywhere along the length of the wear block 144. The cut-out section(s) can take any shape, size or configuration and can, for example, have a squared shape (e.g., cut-out sections 151*a*, 151*c*), a semi-circular shape (e.g., cut-out section 151*b*), a regular shape, and irregular shape, etc. The exposed debris-contacting edges can thus be straight, curved, etc.

By fixing the wear block 144 directly to the front surface 134 of the blade main section 128, providing the entire wear block 144 to be in contact with the debris, the resistance of the sweeping blade devices 126 against potential impacts (i.e., icepacks, manholes, bridge joints, rail tracks, rocks, other hard objects, etc.) can be increased. Therefore, it can be considered that the sweeping blade devices 126 are reinforced in comparison with similar sweeping blade devices manufactured without the wear block 144. Also, the serrated design of the sweeping blade device 126 and, more particularly, of the wear block 144, provided by the alternating teeth 180 and cut-out sections 151*a*, 151*b*, 151*c* can help to crush or grind the debris located in front of the reinforced sweeping blade devices 126 during operation of the apparatus. The improved sweeping blade devices 126 can therefore increase the overall strength of a sweeping blade assembly and can help in efficiently clearing snow and ice from roads, even in harsh conditions.

Figure 8:
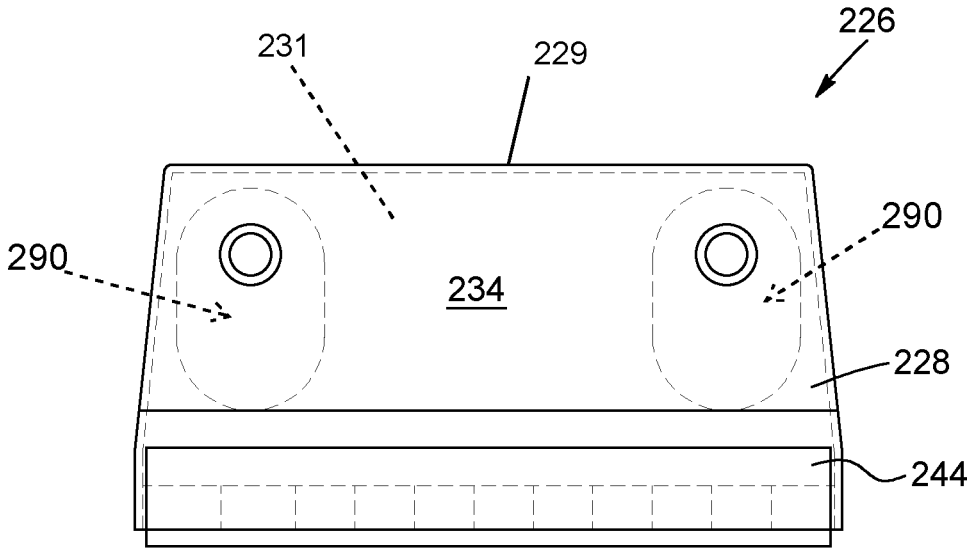
FIG. 8 is a front elevation and cross-sectional view of the sweeping blade device of FIG. 7.
Figure 9:
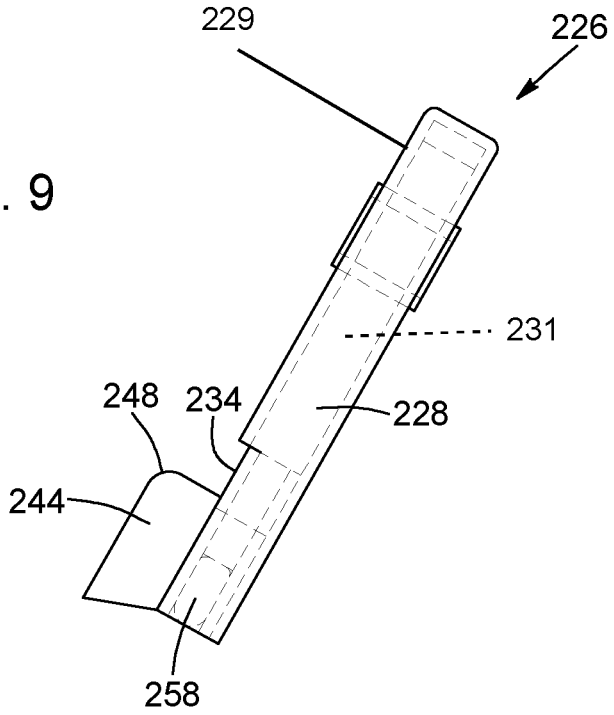
FIG. 9 is a side elevation and cross-sectional view of the sweeping blade device of FIG. 7.
Figure 10:
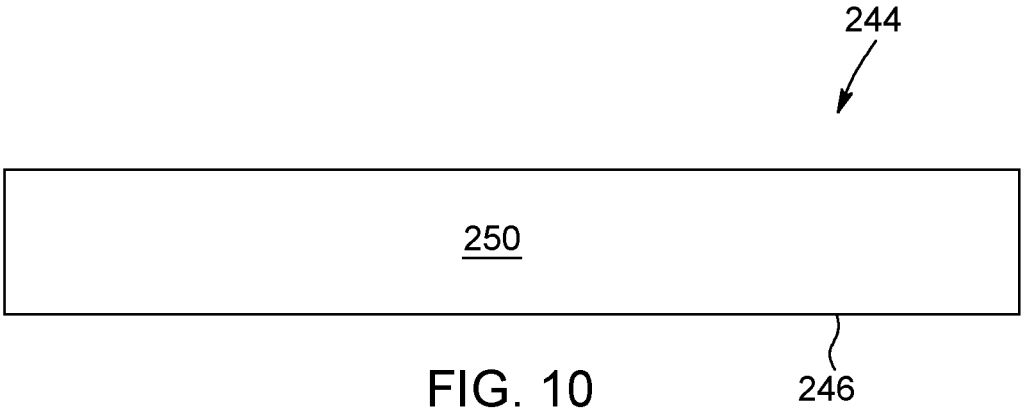
FIG. 10 is a front elevation view of the wear block being secured to the blade main section of the sweeping blade device of FIG. 7.
Figure 11:
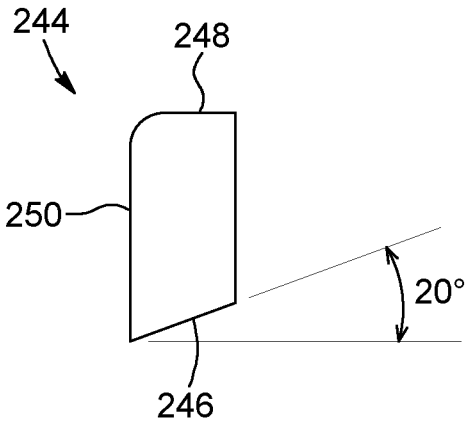
FIG. 11 is a side elevation view of the wear block of FIG. 10.

It is further noted that a person skilled in the art to which the reinforced sweeping blade devices pertain would also understand that a single wear block can be provided without any cut-out sections that extend therethrough. Indeed, as best shown in the non-limitative embodiment of FIGS. 7 to 11, wherein the features are numbered with reference numerals in the 200 series which correspond to the reference numerals of the previous embodiments, a wear block 244 defines a blade mounting surface or rear surface that is superposed directly to a front surface 234 of a blade main section 228 of a sweeping blade device 226. A block front surface 250 can thus be exposed in its entirety to ice and snow debris. The wear or durable block 244 extends between an upper edge 248 and a scraping edge 246. The wear block 244 is attached to the front surface 234 of the blade main section 228 at a lower portion 227 thereof such that the entire wear block 244 can be in contact with the debris when the snowplow vehicle or apparatus is in operation. Again, and as best shown in the non-limitative embodiment of FIGS. 9 and 11, the scraping edge 246 of the wear block 244 can be beveled, with the height of the wear block 244 increasing along the operating direction of the snowplow vehicle or apparatus (or forwardly), so that once the sweeping blade assembly (not shown) or sweeping blade devices 226 are provided in a tilted operating configuration (as shown in FIG. 9), the scraping edges 246 of the wear blocks 244 can contact substantially along their entire width and scrape the surface. As best shown in FIG. 11, the angle of the beveled scraping edge 246 can be between about 1 and 80 degrees, between about 5 and 70 degrees, or between about 35 and 50 degrees, for example.

The wear block 244 can be welded to the front surface 234 of the blade main section 228. A person skilled in the art to which the present sweeping blade device 226 pertains would however understand that other attachment means could be used to secure the wear block 244 to the blade main section 228, including studs, press fit studs, rivets or adhesive, for example.

By fixing a wear block 244, that defines no cut-out sections, directly to the front surface 234 of the blade main section 228, providing the entire wear block 244 to be in contact with the debris, the resistance of the sweeping blade devices 226 against potential impacts (i.e., icepacks, manholes, bridge joints, rail tracks, rocks, other hard objects, etc.) can be increased. For example, the wear block 244 can protect the blade inserts 258, which can be easily chipped, against potential impacts with icepacks, manholes, bridge joints, rail tracks, rocks, other hard objects, etc. Therefore, it can be considered that the sweeping blade devices 226 are reinforced in comparison with similar sweeping blade devices manufactured without the wear block 244.

Referring to FIGS. 12 to 14, there is shown an alternative embodiment of the sweeping blade device wherein the features are numbered with reference numerals in the 300 series which correspond to the reference numerals of the previous embodiments. This embodiment shares similar features with the embodiment of FIGS. 5 and 6. More particularly, the sweeping blade device 326 has a blade main section 328 and a wear block 344 attached to the blade main section 328 in the scraping marginal edge region 327 (or lower portion). The wear block 344 protrudes forwardly from the front surface 334 of the blade main section 328 and comprises a plurality of cut-out sections 351*a*, 351*b*, 351*c* which extend through the wear block 344 upwardly from the scraping edge 346. The cut-out sections 351*a*, 351*b*, 351*c* define a plurality of teeth 380 with adjacent ones of the teeth 380 being spaced-apart by one of the cut-out sections 351*a*, 351*b*, 351*c* in the lower portion of the wear block 344.

Even though, the wear block 344 is shown with a straight scraping edge 346, it is appreciated that, in an alternative embodiment (not shown), its scraping edge can be beveled, with the height of the wear block 344 increasing along the operating direction of the snowplow vehicle or apparatus (i.e. a forwardly increasing height).

In the embodiment shown, the scraping edge 346 extends below the scraping edge 330 of the blade main section 328. In a non-limitative embodiment, a length of a portion of the wear block extending downwardly past the blade scraping edge can range between about 0.1 inch and about 2 inches and, in a particular embodiment, between about 0.1 inch and about 1 inch. However, in an alternative embodiment (not shown), both scraping edges 330, 246 can be leveled.

While in the previous embodiments, the wear block 44, 144, 244 extends continuously along an entire length of the blade main section 328, in the embodiment shown, the wear block 344 comprises a plurality of wear block sections 344*a*, 344*b*, 344*c* mounted in an adjacent configuration. More particularly, in the particular embodiment of FIGS. 12 to 14, the sweeping blade device 326 comprises three (3) wear block sections 344*a*, 344*b*, 344*c*. It is appreciated that the number can vary.

The wear block sections 344*a*, 344*b*, 344*c* are mounted in a juxtaposed configuration with substantially no spacing between edges of adjacent ones of the wear block sections 344*a*, 344*b*, 344*c*. However, in an alternative embodiment (not shown), the edges of adjacent ones of the wear block sections 344*a*, 344*b*, 344*c* can be spaced-apart to leave a portion of the front surface 334 of the blade main section 328 exposed in the scraping marginal edge region 327 (or lower portion) in between the wear block sections 344*a*, 344*b*, 344*c*.

In the embodiment shown, each one of the wear block sections 344*a*, 344*b*, 344*c* includes one cut-out section 351*a*, 351*b*, 351*c*. However, it is appreciated that each one of the wear block sections 344*a*, 344*b*, 344*c* can include more than one cut-out section or can be free of cut-out section. More particularly, when the wear block sections 344*a*, 344*b*, 344*c* are configured in a spaced-apart configuration along the length of the blade main section 328, they can be free of cut-out section.

Each one of the wear block sections 344*a*, 344*b*, 344*c* has a profile with curved edges extending upwardly from the scraping edge 346. It is appreciated that the profile of the wear block sections 344*a*, 344*b*, 344*c* can vary from the embodiment shown. Furthermore, the adjacent wear block sections 344*a*, 344*b*, 344*c* can have a different profile, as shown in FIGS. 12 to 14. Furthermore, the shape of the cut-out section 351*a*, 351*b*, 351*c* can vary from the embodiment shown.

Figure 15:
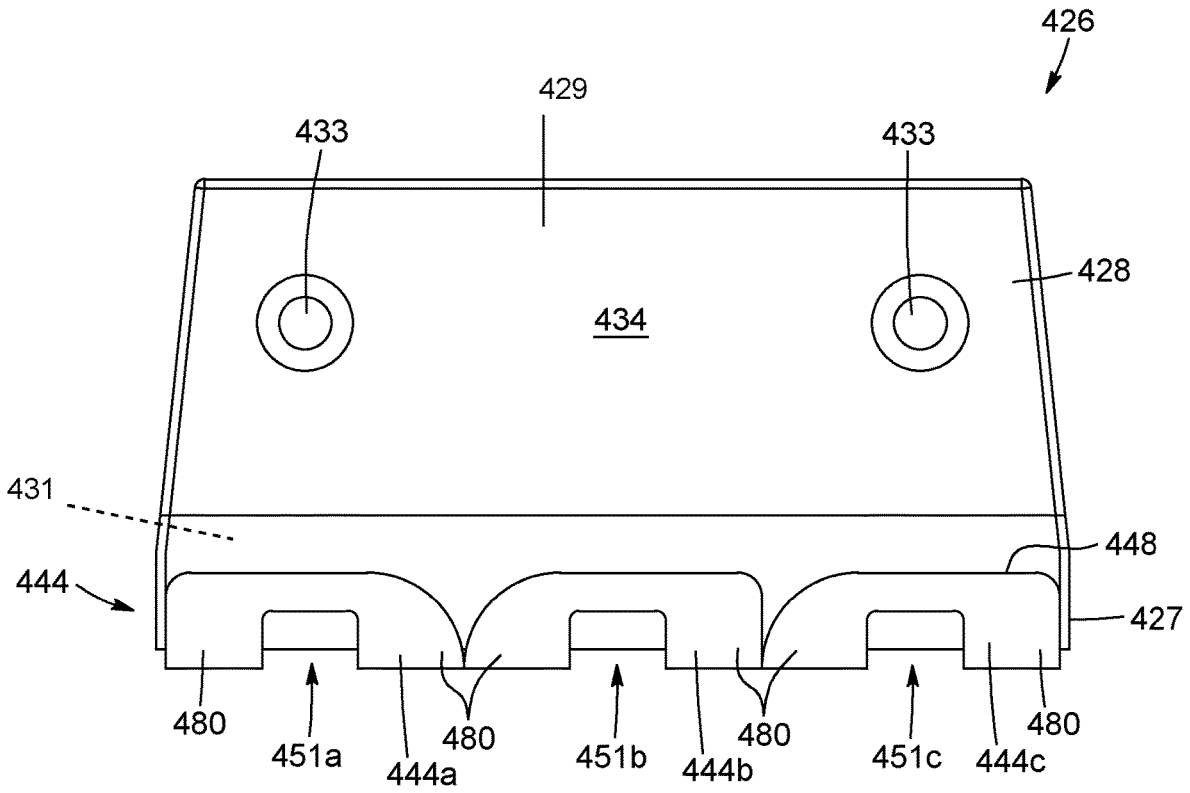
FIG. 15 is a front elevation view of a sweeping blade device in accordance with an alternative embodiment, wherein the wear block comprises a plurality of adjacently mounted wear blocks but having a different shape from the wear blocks shown in FIGS. 12 to 14.

Turning now to FIG. 15, there is shown an alternative embodiment of the sweeping blade device wherein the features are numbered with reference numerals in the 400 series which correspond to the reference numerals of the previous embodiments. This embodiment shares similar features with the embodiment of FIGS. 12 to 14, except that the profile of the wear block sections 444*a*, 444*b*, 444*c* is different.

FIGS. 16 to 18 shown another alternative embodiment of the sweeping blade device wherein the features are numbered with reference numerals in the 500 series which correspond to the reference numerals of the previous embodiments. Contrary to the embodiments of FIGS. 12 to 15, the embodiment of FIGS. 16 to 18 includes a wear block 544 with a single section extending along an entire length of the blade main section 528. The wear block 544 has a blade mounting surface or rear surface that is superposed directly to a front surface 534 in a manner such that a block front surface 550 is exposed in its entirety to ice and snow debris. Thus, the wear block 544 is attached to the front surface 534 of the blade main section 528 at a lower portion 527 thereof. The scraping edge 546 of the wear block 544 is beveled, with the height of the wear block 544 increasing along the operating direction of the snowplow vehicle or apparatus (or forwardly). Once again, the angle of the beveled scraping edge 246 can be between about 1 and 80 degrees, between about 5 and 70 degrees, or between about 35 and 50 degrees, for example.

However, it is appreciated that, in an alternative embodiment (not shown), the wear block 544 can have a straight scraping edge which can either be aligned with or extend below the blade scraping edge 530 to contact the ground surface.

In the embodiment shown, the blade main section 528 includes an indentation in the lower portion 527. Therefore, when the wear block 544 is superposed to the blade main section 528 and mounted thereto, a rear portion of the wear block 544 is recessed with respect to the front surface 534 of the blade main section 528, in the upper portion thereof.

The wear block 544 comprises a plurality of cut-out sections 551*a*, 551*b*, 551*c*, extending through the wear block 544 upwardly from the scraping edge 546 and defining a plurality of teeth 580 inbetween. Thus, at the front face 550 of the wear block 544, the teeth 580 are delimitated from the cut-out sections 551*a*, 551*b*, 551*c* by debris-contacting edges 553*a*, 553*b*, 553*c* extending upwardly from the scraping edge 546.

The wear block 544 has beveled lateral edges providing a generally trapezoidal shape with the scraping edge 546 being wider than the wear block upper edge 548.

Once again, it is appreciated that the profile of the wear block 344 can vary from the embodiment shown. Amongst others, the shape and configuration of the wear block 544 and the cut-out sections 551*a*, 551*b*, 551*c* can vary from the embodiment shown.

For all the above-described embodiments, the wear block can be welded to the front surface of the blade main section. A person skilled in the art to which the present sweeping blade device pertains would however understand that other attachment means could be used to secure the wear block to the blade main section, including mechanic fasteners, studs, press fit studs, rivets or adhesive, for example.

It will be appreciated by a person skilled in the art to which the sweeping blade device 126 pertains that the wear block (or wear block sections) can take any shape, size or configuration, with the entire wear block being exposed to the debris and including cut-out sections that might extend therethrough, thus presenting at least one debris-contacting edge that extends upwardly from the scraping edge, for example. It is thus noted that one or more cut-out section(s) can extend through the scraping edge of the wear block and can be positioned anywhere along the length of the wear block. The cut-out section(s) can take any shape, size or configuration and can, for example, have a squared shape (e.g., cut-out sections 151*a*, 151*c*), a semi-circular shape (e.g., cut-out section 151*b*), a regular shape, and irregular shape, etc. The exposed debris-contacting edges can thus be straight, curved, etc.

In an embodiment, the wear block height ranges between about ⅙ and about ⅓ of the main blade height and, in a particular embodiment, between about ⅕ and about ¼ of the main blade height. In an embodiment, the wear block thickness ranges between about 0.5 time and about 2 times the main blade thickness and, in a particular embodiment, between about 0.75 time and 1.5 times the main blade thickness. In a non-limitative embodiment, the wear block thickness is substantially the same as the main block thickness.

By fixing the wear block directly to the front surface of the blade main section, providing the entire wear block to be in contact with the debris, the resistance of the sweeping blade devices against potential impacts (i.e., icepacks, manholes, bridge joints, rail tracks, rocks, other hard objects, etc.) can be increased. Therefore, it can be considered that the sweeping blade devices are reinforced in comparison with similar sweeping blade devices manufactured without the wear block. Also, the serrated design of the sweeping blade device and, more particularly, of the wear block, provided by the alternating teeth and cut-out sections can help to crush or grind the debris located in front of the reinforced sweeping blade devices during operation of the apparatus. The improved sweeping blade devices can therefore increase the overall strength of a sweeping blade assembly and can help in efficiently clearing snow and ice from roads, even in harsh conditions.

In some implementations, the blade support 12 (such as the vehicle mounting portion 14 and the sweeping blade mounting portion 20), the plurality of reinforced sweeping blade devices 26, 126, 226, 326, 426 or 526 and/or the plurality of mechanical fasteners 24 can be secured one to another by preventing metal-to-metal contact between the components/parts of the sweeping blade assembly. In some non-limitative implementations, the external surface of the blade main section interfacing with the internal surfaces of the vehicle mounting portion 14 and the sweeping blade mounting portion 20 (with the surfaces of the blade support 12 facing the reinforced sweeping blade devices 26, 126, 226, 326, 426, 526) can be lined, at least partially or entirely, with a resilient layer 29, 129, 229, 329, 429, 529 so as to prevent metal-to-metal contact between the blade support 12 and the reinforced sweeping blade devices 26, 126, 226, 326, 426, 526, thereby absorbing impact and vibrations, and more particularly, so as to prevent metal-to-metal contact between the internal surfaces of the vehicle mounting portion 14 and the sweeping blade mounting portion 20 and the reinforced sweeping blade devices 26, 226. In some implementations, such as the ones shown in FIGS. 3, 4, and 7 to 18, only a portion of the front surface of the blade main sections is lined with a resilient layer 29, 129, 229, 329, 429, 529 and, more particularly, the upper portion extending above the wear block. Thus, in the lower portions of the sweeping blade devices, the wear blocks are mounted directly to the metal-based portion of the main blade section.

It is noted that the wear block-supporting projections 54*a*, 54*b*, if any, can also be lined with the resilient layer 29, 129, 229, 329, 429, 529. The blade inserts can however remain exposed so as to be able to be in contact with the surface to be scraped. Similarly, the wear blocks can remain exposed so as to be able to be in contact with the debris. Peripheral surfaces delimiting the blade apertures 33 can also be lined with a resilient layer. A person skilled in the art to which the sweeping blade assembly 10 pertains would understand that at least a section of the blade support 12 and/or of the reinforced sweeping blade devices 26, 226 can be lined with the resilient layer(s), so as to prevent metal-to-metal contact between these components. The resilient layer 29, 129, 229, 329, 429, 529 can be made of a flexible material such as a rubber-like material, but it will be appreciated that other materials can be used.

In some implementations, the sweeping blade assembly 10 can include one or more bushing assembly for each sweeping blade device. In most of the embodiments shown in the figures, each sweeping blade device comprises two resilient bushing assemblies, one for each blade-support mounting aperture. More particularly, as shown in FIGS. 5, 6, and 8, the metal-based portion of the main blade section, the blade portion 131, 231, have two bushing holes 190, 290 extending therethrough, spaced-apart along the length L of the sweeping blade device. In the non-limitative embodiment shown, the bushing holes 190, 290 are located substantially in an upper portion of the blade portion 131, 231 but, in an alternative embodiment, they could be located substantially centrally of a height of the blade portion 131, 231. In the non-limitative embodiment shown, the bushing holes 190, 290 have a substantially elliptical cross-section, but it is appreciated that it can be characterized by a different shape (oval, circular, rectangular with or without rounded corners, square, etc).

More particularly, each one of the resilient bushing assemblies is received in a corresponding one of the bushing holes 190, 290. Since both bushing holes 190, 290 are substantially identical, only one will be described in the paragraphs below. A diameter of the bushing hole 190, 290 is wider than a diameter of the mechanical fastener (not shown) used to connect the blade main section to the blade support 12. The resilient bushing assembly comprises a resilient bushing at least partially filing an internal space in the bushing hole 190, 290 and defined between a periphery of the bushing hole 190, 290 and the mechanical fastener (not shown) received therein. Peripherally, the resilient bushing substantially conforms to the shape of the bushing hole. In the non-limitative embodiment shown, the resilient bushing assembly further comprises a rigid sleeve 192, 292, such as rigid polymeric or a metal-based sleeve, received in an aperture defined in the resilient bushing. The rigid sleeve 192, 292 defines the blade-support mounting aperture, which extends therethrough and is designed to receive the mechanical fastener (or sweeping blade fastener).

The rigid sleeve 192, 292 prevents direct contact between the resilient bushing and the mechanical fastener. More particularly, the resilient bushing can be configured to surround the rigid sleeve 192, 292. The rigid sleeve 192, 292 is used to operatively and detacheably/removeably secure the blade main section to the blade support 12, whereby as the blade main section vibrates and moves at an attack angle and angularly in response to road obstacles, these vibrations and shocks are absorbed and/or dampened by the resilient bushing which is provided between the metal portion of the blade main section, i.e. the blade portion 131, 231, and the rigid sleeve 192, 292 to avoid any metal-to-metal contact. A metal-to-metal contact (for instance, without the resilient bushing) results in an increase in wear and repair due to vibration which causes costs increase to the user of such a blade for removing snow from all kinds of roads and surfaces.

In the non-limitative embodiment shown, the rigid sleeve 192, 292 is centrally mounted with respect to the bushing hole 190, 290. However, in an alternative embodiment (not shown), it can be mounted eccentric with respect to the bushing hole 190, 290, for instance and without being limitative, in an upper portion thereof.

In an embodiment, one or more airgaps (not shown) can be provided within the resilient bushing for improving the compressibility thereof. This arrangement allows for increased movement flexibility of the blade main section, wherein, when the resilient bushing is compressed, the blade main section may move upward to avoid the obstacle and reduce its impact on the entire sweeping blade assembly 10. Whereas when the obstacle happens to be closer to one lateral edges of the blade main section than the other, the bushing assemblies allow to the blade main section to move angularly and rotate to one side (or to tilt) to reduce the impact of the obstacle onto the sweeping blade assembly 10.

In the embodiments shown, each one of the sweeping blade devices comprises two bushing assemblies, spaced-apart from one another along the length L of the sweeping blade devices. However, in an alternative embodiment (not shown), each one of the sweeping blade devices can comprise a single bushing assembly, which can be centrally mounted along the length L thereof. In still another alternative embodiment (not shown), each one of the sweeping blade devices can comprise more than two bushing assemblies.

The resilient bushing and the resilient material layer 29, 129, 229, 329, 429, 529, if any, are at least partially made of a resilient material. The expression "resilient material" is intended to mean a material which absorbs energy when it is deformed elastically and then, when the force causing the deformation is removed, unloads this energy by substantially taking back its initial shape. Examples include, without limitations, natural rubber, polymeric material, a wide range of composite material and the like. The expression "rubber material" is intended to mean a material in which bond lengths deviate from the equilibrium (minimum energy) and strain energy is stored electrostatically. Examples include, without limitations, compositions of nitrile, hydrogenated nitrile, ethylene-propylene, fluorocarbon, chloroprene, silicone, fluorosilicone, polyacrylate, ethylene acrylic, styrene-butadiene, polyurethane, rubber material and the like.

In a non-limitative embodiment, the resilient bushing and the resilient material layer are integral forming a single continuous unit.

In the non-limitative embodiment shown, the resilient material layer 29, 129, 229, 329, 429, 529 covers the sweeping blade along its entire height H, from the lower edge to the upper edge. However, in an alternative embodiment, as described above, the resilient material layer 29, 129, 229, 329, 429, 529 could cover only a portion thereof and, in still another alternative embodiment, the blade main section could be free of resilient material layer.

The resilient bushing being compressible, they allow for limited free movement of the blade main section with respect to the blade support 12. More particularly, the blade main sections can translate/slide between the vehicle mounting portion (or first plate) 14 and the sweeping blade mounting portion (or second plate) 20. They can slide substantially linearly with the lower or scraping edge 30, 130, 230, 330, 430, 530 remaining substantially parallel to longitudinal edges of the vehicle mounting portion 14 and the sweeping blade mounting portion 20 or in an angular manner wherein the blade main section tilts or pivots. When displaced in an angular manner, the lower or scraping edge 30, 130, 230, 330, 430, 530 of the blade main section defines an oblique angle with the longitudinal edges of the vehicle mounting portion 14 and the sweeping blade mounting portion 20.

As mentioned above, depending on the location of the obstacle hit by the blade main section with respect to its lower or scraping edge 30, the blade main section will experience a linear displacement or an angular displacement. As the properties of the material of the resilient bushing and the diameter of the bushing hole 190, 290, amongst others, limits the linear displacement of blade main section with respect to the blade support 12, the angular displacement is limited by the relative position of adjacent sweeping blade devices 26, i.e. the gap 23 defined between adjacent sweeping blade devices 26. For the purpose of this description, the tilting angle corresponds to the angle defined between the lower or scraping edge 30 of the blade main section and the longitudinal edges of the vehicle mounting portion 14 and the sweeping blade mounting portion 20 (or the ground surface or an horizontally-extending axis).

The ability to have absolutely no (or at least minimize) metal-to-metal contact (or to reduce the metal-to-metal contact) can significantly reduce the vibration throughout the whole sweeping blade assembly 10 and can result in more complete and efficient snow removal by way of example only. It can also reduce overall operating costs. Another benefit of using the resilient layer is that, as the resilient layer deforms, it can allow the reinforced sweeping blade devices to move slightly in response to uneven surfaces, obstructions or debris, while not placing undue stress on the blade support 12 of the sweeping blade assembly 10.

The configuration of the reinforced sweeping blade device 26, 126, 226, 336, 436, 536 allows the scraping edges of the wear blocks to be in contact with both the surface to be scraped and the debris in front of the assembly 10 (while the entire wear blocks can be in contact with the debris).

According to some non-limitative embodiments, these debris can be crushed more easily, which can reduce the stress on the sweeping blade assembly 10. Indeed, the serrated configuration of the wear blocks (i.e., spaced-apart teeth are formed inbetween the spaced-apart cut-out sections) allows penetration of icepacks, for example, within the cut-out sections which extend through the scraping edge and which are spaced-apart along a length of the blade main section (or alternatively, inbetween adjacent wear blocks). Icepacks can thus interact with the debris-contacting edges of the teeth delimiting the cut-out sections and that extend downwardly from the downwardly-opened longitudinal wear-block receiving channel (or upwardly from the scraping edge in the scenario where the wear block is attached directly to the blade main section). The resistance of the whole sweeping blade assembly 10 against potential impacts (i.e., icepacks, manholes, bridge joints, rail tracks, rocks, other hard objects, etc.) can also be increased. The improved sweeping blade devices having wear blocks attached to the front surfaces of the blade main sections can therefore increase the overall strength of the sweeping blade assembly 10 and can help in efficiently clearing snow and ice from roads, even in harsh conditions, as mentioned above. Using highly durable or wear block(s) 44 on the blade main section indeed allows running the blade main section over very rough conditions (icepacks, manholes, bridge joints, rail tracks, rocks, other hard objects, etc.). The reinforced sweeping blade devices that are mounted to the blade support 12 can thus be replaced after longer periods of time. This makes every single replacement more economical and ecological.

It will thus be appreciated by a person skilled in the art to which the sweeping blade assembly 10 pertains that the blade support 12, the reinforced sweeping blade devices, the bracket(s) (if any), the wear block(s) and the wear block-supporting projection(s) (if any) can take any suitable shape, size or configuration, with the wear block(s) being configured and positioned on the blade main section so as to increase the resistance of the assembly 10 against impacts and in accordance with some non-limitative embodiments, increase efficiency during snow removal operations or other similar operations. For example, the wear block(s) can protect the blade inserts, or at least some of the blade inserts, which can be easily chipped, against potential impacts with icepacks, manholes, bridge joints, rail tracks, rocks, other hard objects, etc.

In the above description, an embodiment is an example or implementation of the sweeping blade assembly and/or the sweeping blade device, for instance. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment. Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A sweeping blade device configured to be mounted to a blade support securable to a vehicle, the sweeping blade device comprising:

a blade main section extending between a blade scraping edge and a blade upper edge and having a front surface, the blade main section having a scraping marginal edge region extending upwardly from the blade scraping edge and further comprising a blade portion and a resilient material layer superposed to a front surface of the blade portion with the front surface of the blade portion being exposed forwardly in the scraping marginal edge region; and a wear block attached to the blade main section in the scraping marginal edge region, and protruding forwardly from the front surface of the blade main section, the wear block having a wear block scraping edge being aligned with or extending below the blade scraping edge to contact a ground surface.

2. The sweeping blade device of claim 1, wherein the wear block comprises at least one cut-out section extending upwardly from the wear block scraping edge and defining at least two spaced-apart teeth in a lower portion of the wear block.

3. The sweeping blade device of claim 2, wherein the wear block scraping edge protrudes downwardly from the blade scraping edge and the at least one cut-out section extending upwardly past the blade scraping edge exposing partially the scraping marginal edge region of the blade main section.

4. The sweeping blade device of claim 2, wherein the wear block comprises a plurality of the at least one cut-out section.

5. The sweeping blade device of claim 1, wherein the wear block scraping edge protrudes downwardly from the blade scraping edge and a length of a portion of the wear block extending downwardly past the blade scraping edge ranges between about 0.1 inch and about 2 inches.

6. The sweeping blade device of claim 1, wherein the wear block comprises a plurality of the wear block sections mounted in an adjacent configuration to the blade main section.

7. The sweeping blade device of claim 6, wherein the wear blocks are juxtaposed along the blade scraping edge.

8. The sweeping blade device of claim 1, wherein the wear block scraping edge is beveled.

9. The sweeping blade device of claim 1, wherein the wear block is steel-based.

10. The sweeping blade device of claim 1, wherein the wear block is superposed directly and secured to the front surface of the blade portion.

11. The sweeping blade device of claim 1, wherein the wear block is welded to the front surface of the blade portion.

12. The sweeping blade device of claim 1, wherein the blade portion is thinner in the scraping marginal edge region than in an upper portion thereof.

13. The sweeping blade device of claim 1, wherein the blade main section has a main blade height and the wear block has a wear block height, the wear block height ranging between ⅙ and about ⅓ of the main blade height.

14. The sweeping blade device of claim 1, wherein the blade main section has a main blade thickness and the wear block has a wear block thickness, the wear block thickness ranging between about 0.5 and 2 times the main blade thickness.

15. A sweeping blade assembly configured to be attached to a plow blade of a vehicle for sweeping debris on a ground surface, the sweeping blade assembly comprising:

a blade support securable to the plow blade of the vehicle; and a plurality of the sweeping blade device of claim 1.

16. A sweeping blade device configured to be mounted to a blade support securable to a plow blade of a vehicle for sweeping debris on a ground surface, the sweeping blade device comprising:

a blade main section extending between a scraping edge and a blade upper edge, the blade main section defining a front surface; and a bracket attached to the front surface of the blade main section at the scraping edge thereof and defining a downwardly-opened longitudinal wear block-receiving channel; and a wear block having an upper portion inserted in the downwardly-opened longitudinal wear block-receiving channel and a lower portion extending downwardly therefrom, the wear block extending between a scraping edge configured to contact both the debris and the ground surface and a block upper edge, the wear block having at least one cut-out section extending upwardly from the scraping edge and defining at least two spaced-apart teeth in the lower portion of the wear block.

17. A sweeping blade assembly configured to be attached to a plow blade of a vehicle for sweeping debris on a ground surface, the sweeping blade assembly comprising:

a blade support securable to the plow blade of the vehicle; and a plurality of sweeping blade devices mounted to the blade support, each one of the sweeping blade devices comprising:

a blade main section extending between a scraping edge and a blade upper edge, the blade main section defining a front surface;

a bracket attached to the front surface of the blade main section in a lower portion thereof and defining a downwardly-opened longitudinal wear block-receiving channel; and a wear block secured to the bracket and having an upper portion inserted in the downwardly-opened longitudinal wear block-receiving channel and a lower portion extending downwardly from the downwardly-opened longitudinal wear block-receiving channel and exposed forwardly of the blade main section, the wear block extending between a scraping edge configured to contact both the debris and the ground surface and a block upper edge contained in the downwardly-opened longitudinal wear block-receiving channel, the wear block having at least one cut-out section extending upwardly from the scraping edge and defining at least two spaced-apart teeth in the lower portion of the wear block.

18. The sweeping blade assembly of claim 17, wherein the blade main section comprises a downwardly-opened longitudinal insert-receiving channel extending upwardly from the scraping edge thereof and a plurality of blade inserts at least partially inserted in the downwardly-opened longitudinal insert-receiving channel of the blade main section and secured to the blade main section.

* * * * *